US012642357B1

(12) United States Patent
Massam et al.

(10) Patent No.: US 12,642,357 B1
(45) Date of Patent: Jun. 2, 2026

(54) BOOK BASKET

(71) Applicant: Academia Furniture, LLC, Wood-Ridge, NJ (US)

(72) Inventors: Daniel Massam, Philadelphia, PA (US); Thomas Murray, Philadelphia, PA (US)

(73) Assignee: Academia Furniture, LLC, Wood-Ridge, NJ (US)

( * ) Notice: Subject to any disclaimer, the term of this patent is extended or adjusted under 35 U.S.C. 154(b) by 0 days.

(21) Appl. No.: 19/374,176

(22) Filed: Oct. 30, 2025

(51) Int. Cl.

| | |
|---|---|
| ***A47C 7/62*** | (2006.01) |
| ***A47B 91/06*** | (2006.01) |
| ***A47C 3/04*** | (2006.01) |
| ***A47C 5/12*** | (2006.01) |
| ***A47C 7/64*** | (2006.01) |

(52) U.S. Cl.
CPC ..... *A47C 7/626* (2018.08); *A47B 91/06* (2013.01); *A47C 3/04* (2013.01); *A47C 5/12* (2013.01); *A47C 7/64* (2013.01)

(58) Field of Classification Search
CPC .. A47C 7/626; A47C 3/04; A47C 5/12; A47C 7/64; A47C 7/62; A47C 7/622; A47C 5/00; A47B 91/06
See application file for complete search history.

(56) References Cited

U.S. PATENT DOCUMENTS 2,747,654 A * 5/1956 Chapman ..... A47C 7/002 297/239
3,156,498 A * 11/1964 Blodee ..... A47C 3/04 297/239
3,160,438 A * 12/1964 Davis ..... A47B 83/00 211/181.1
3,380,778 A * 4/1968 Barecki ..... A47C 3/04 297/239
3,497,262 A * 2/1970 Piretti ..... A47C 1/124 297/239
4,913,496 A 4/1990 Oke
5,123,702 A 6/1992 Caruso
5,924,770 A 7/1999 Tarnay et al.
6,135,562 A 10/2000 Infanti
8,454,088 B2 6/2013 Shokouhi
8,528,969 B2 * 9/2013 Huang ..... A47C 7/70 297/162
8,967,714 B2 * 3/2015 Machael ..... A47C 3/045 297/239
9,826,838 B2 11/2017 Piretti
9,986,839 B2 6/2018 Pectol
(Continued)

*Primary Examiner* — David R Dunn
*Assistant Examiner* — Jessica Kathryn Thompson
(74) *Attorney, Agent, or Firm* — Weiss & Arons LLP

(57) ABSTRACT

A book basket for fixed placement on an underside of a seat of a chair is provided. The book basket includes a frame. The frame includes a first stadium-shaped orifice, a second stadium-shaped orifice and a plurality of connectors connecting the first stadium-shaped orifice to the second stadium-shaped orifice. The first stadium-shaped orifice enables insertion and removal of one or more items. The second stadium-shaped orifice includes a blocker to prevent passage therethrough of the one or more items. A first curvature of the first stadium-shaped orifice matches a first curvature of a seat of the chair. A second curvature of the second stadium-shaped orifice matches a second curvature of the seat of the chair.

12 Claims, 35 Drawing Sheets

(56) References Cited

U.S. PATENT DOCUMENTS

| | | | | |
|---|---|---|---|---|
| 10,485,350 | B2 * | 11/2019 | Lenhart | A47C 7/40 |
| 12,527,401 | B2 * | 1/2026 | Gatfield | A47C 3/0252 |
| 2005/0099052 | A1 | 5/2005 | Bertolini et al. | |
| 2005/0151409 | A1 | 7/2005 | Infanti et al. | |
| 2007/0045485 | A1 * | 3/2007 | Nichols | A47B 13/086 248/118 |
| 2010/0276971 | A1 | 11/2010 | Maxwell et al. | |
| 2011/0062754 | A1 * | 3/2011 | Mills | A47C 7/62 297/188.08 |
| 2011/0278889 | A1 | 11/2011 | Sienkowski et al. | |
| 2012/0019038 | A1 | 1/2012 | Mezzera | |
| 2014/0077573 | A1 | 3/2014 | Schneider et al. | |
| 2022/0265051 | A1 * | 8/2022 | Scharfenkamp | A47C 7/626 |
| 2024/0324780 | A1 | 10/2024 | Ding et al. | |

* cited by examiner

Section 9-9

Section 27-27

BOOK BASKET

FIELD OF TECHNOLOGY

Aspects of the disclosure relate to mechanical designs and apparatus. Specifically, aspects of the disclosure relate to book baskets for placement on a classroom chair.

BACKGROUND OF THE DISCLOSURE

Chairs may enable people to perform one or more tasks in a sitting position. Chairs are used in various settings. The settings may include a dining setting, a conference setting and a classroom setting.

Conventionally, in a classroom setting, other furniture, in addition to chairs, may be required. Other such furniture may include hooks to hold belongings, such as coats and bookbags. Other such furniture may also include shelves to store books.

At times, the hooks and shelves occupy space in a classroom. A classroom that includes other furniture in addition to chairs may appear cluttered. A cluttered classroom may hinder the learning that transpires in the classroom.

Therefore, it would be desirable to create a chair that would minimize the furniture required in a classroom. Such a chair may include a hook to hold belongings. Such a chair may include a basket to store books.

It should be noted that chairs may be stacked while not in use. Stacking chairs may be instrumental to ensuring that floor space is available when needed. As such, it would be further desirable for such a chair to be stackable in addition to including both a hook and a basket.

SUMMARY OF THE DISCLOSURE

A stack of multiple chairs is provided. Each chair included in the multiple chairs may include a book basket. The stack may include a first chair. The stack may include a second chair.

A first chair is provided. The first chair may include a first chair back. The first chair may include a first chair seat. The first chair may include a first bracket. The first chair may include a first chair support. The first chair may include a second chair support. The first chair may include a first bar. The first chair may include a second bar. The first chair may include a first book basket.

The first chair may include a first chair back. The first chair back may include a poly-molded material. The first chair back may house a plate. The first chair back may be molded around the plate. The plate may include steel, aluminum, metal and/or any other suitable material.

The first chair back may define a first aperture. The first aperture may expose at least a portion of a face of the plate. The first aperture may be defined within a lower portion of the chair back.

The first chair may include a first chair seat. The first chair seat may include a poly-molded material. The first chair seat may define a back-to-front axis. The back-to-front axis may be defined with respect to the first chair back. As such, the back-to-front axis may run from the back of the first chair to the front of the first chair.

The first chair seat may define a second aperture. The second aperture may be defined within the back of the first chair seat. The second aperture may be engaged with a first bracket.

The first chair may include a first bracket. The first bracket may include steel, aluminum, metal and/or any other suitable material. The first bracket may connect an underside of the chair seat to the plate. The first bracket may extend through the second aperture. As such, the first bracket may connect the chair seat to the chair back.

The first chair may include a first chair support. The first chair support may include one or more legs. Preferably, the first chair support may include two legs. The first chair support may be formed from steel, metal, aluminum and/or any other suitable materials. The first chair support may be formed from any other suitable material. The first chair support may include a rod. The first chair support may extend parallel to the back-to-front axis.

The first chair support may be disposed on a first side of the first chair seat. The first chair support may be disposed on an underside of the first chair seat. The first chair support may be disposed partially on the underside of the first chair seat.

The first chair may include a second chair support. The second chair support may include one or more legs. Preferably, the second chair support may include two legs. The second chair support may be formed from steel, metal, aluminum and/or any other suitable materials. The second chair support may include a rod. The second chair support may extend parallel to the back-to-front axis.

The second chair support may be disposed on a second side of the first chair seat. The second chair support may be disposed on the underside of the first chair seat. The second chair support may be disposed partially on the underside of the first chair seat.

The first chair may include a first bar. The first bar may connect the first chair support and the second chair support. The first bar may connect the first chair support to the second chair support. The first bar may be formed from steel, metal, aluminum and/or any other suitable material. The first bar may be disposed on the underside of the first chair seat. The first bar may be disposed on a front portion of the underside of the first chair seat.

The first chair may include a second bar. The second bar may connect the first chair support and the second chair support. The second bar may connect the first chair support to the second chair support. The second bar may be formed from steel, metal, aluminum and/or any other suitable material. The second bar may be disposed on the underside of the first chair seat. The second bar may be disposed on a back portion of the underside of the first chair seat.

The first chair may include a first book basket. The first book basket may include steel, metal, aluminum, plastic and/or any other suitable material. The first book basket may include a coating finish. The first book basket may include a powder coat. The first book basket may include any other suitable coat.

The first book basket may include a weight. Preferably, the weight may be 2.9 pounds. The weight may be any other suitable weight. The weight may include any weight listed in Table 1.

TABLE 1

| Illustrative Weights<br>Illustrative Weights. |
|---|
| <1 pound |
| 1-2 pounds |
| 2-3 pounds |
| 3-4 pounds |

TABLE 1-continued

| Illustrative Weights<br>Illustrative Weights. |
|---|
| 4-5 pounds |
| 5-6 pounds |
| 6-7 pounds |
| 7-8 pounds |
| 8-9 pounds |
| >9 pounds |
| Any other suitable weight |
| Any suitable combination thereof |

The first book basket may be mounted to the first chair. The first book basket may be mounted to the underside of the first chair seat. The first book basket may be installed on the underside the first chair support and the second chair support. A surface of the first book basket may be flush with a surface of the first chair support and the second chair support. The first book basket may be mounted via screws, nuts, bolts, adhesives, welding and/or any other suitable attachment method. The first book basket may be attachable to the first chair. The first book basket may be removed from the first chair. The first book basket may promote stacking of the first chair with the second chair. The first book basket may promote stacking of the first chair with any other suitable chair.

The first book basket may include a first frame. The first frame may include a first stadium-shaped orifice. The first frame may include a second stadium-shaped orifice. For purposes of the application, a stadium-shape may be understood to refer to a rectangular shape with semi-circular ends. The shape of the first stadium-shaped orifice may correspond to the shape of the second stadium-shaped orifice.

The first stadium-shaped orifice may include a curvature. The second stadium-shaped orifice may include a curvature. The first chair support may include a curvature. The second chair support may include a curvature. The curvature of the first stadium-shaped orifice may correspond to the curvature of the first chair support. The curvature of the second stadium-shaped orifice may correspond to the curvature of the second chair support. The curvature of the first chair support may correspond to the curvature of the second chair support.

The first frame may include a first plurality of connectors. The first plurality of connectors may connect the first stadium-shaped orifice to the second stadium-shaped orifice. The first plurality of connectors may be straight connectors. The connectors may provide a surface within the first book basket. As such, one or more items may rest within the first book basket.

The first book basket may include a first blocker. The first blocker may be disposed within either the first stadium-shaped orifice or the second stadium-shaped orifice. As such, the stadium-shaped orifice that does not include the blocker may enable insertion and removal of the one or more items. The stadium-shaped orifice that includes the blocker may prevent the one or more items from falling out of the book basket.

The first blocker may include a horizontal wire. The first blocker may include two horizontal wires. As such, the first blocker may run parallel to the back-to-front axis. The blocker may include a vertical wire. The first blocker may include two horizontal wires. As such, the first blocker may run perpendicular to the back-to-front axis. In some embodiments, the first blocker may be horizontal and vertical. The first blocker may include any other suitable shape.

The first book basket may include a first plurality of spacers. Preferably, the first book basket may include four spacers. The first book basket may include any other suitable number of spacers. The first plurality of spacers may be disposed on a portion of the first plurality of connectors located on an underside of the first book basket. The first plurality of spacers may provide a portion of space between each chair when the chair is vertically stacked with another chair. The first book basket may enable vertical stacking of four chairs per linear yard. The first book basket may enable vertical stacking of any other suitable number of chairs per linear yard.

The first book basket may be installed with the second stadium-shaped orifice on the first side of the first chair seat. The first book basket may be installed with the second stadium-shaped orifice on the second side of the chair seat. The one or more items may be inserted and removed at the first side of the first chair seat. The one or more items may be inserted and removed on the second side of the first chair seat.

The stack may include a second chair. The second chair may include a second chair back. The second chair may include a second chair seat. The second chair may include a second bracket. The second chair may include a third chair support. The second chair may include a fourth chair support. The second chair may include a third bar. The second chair may include a fourth bar. The second chair may include a second book basket.

The second chair may include a second chair back. The second chair back may include a poly-molded material. The second chair back may house a plate. The second chair back may be molded around the plate. The plate may include steel, aluminum, metal and/or any other suitable material.

The second chair back may define a third aperture. The third aperture may expose at least a portion of a face of the steel plate. The third aperture may be defined within a lower portion of the second chair back.

The second chair may include a second chair seat. The second chair seat may include a poly-molded material. The second chair seat may define a back-to-front axis. The back-to-front axis may be defined with respect to the second chair back. As such, the back-to-front axis may run from the back of the second chair to the front of the second chair.

The second chair seat may define a fourth aperture. The fourth aperture may be defined within the back of the second chair seat. The fourth aperture may be engaged with the second bracket.

The second chair may include a second bracket. The second bracket may include steel, aluminum, metal and/or any other suitable material. The second bracket may connect an underside of the second chair seat to the plate. The second bracket may extend through the fourth aperture. As such, the second bracket may connect the second chair seat to the second chair back.

The second chair may include a third chair support. The third chair support may include one or more legs. Preferably, the third chair support may include two legs. The third chair support may be formed from steel, metal, aluminum and/or any other suitable material. The third chair support may include a rod. The third chair support may extend parallel to the back-to-front axis.

The third chair support may be disposed on a first side of the second chair seat. The first chair support may be disposed on an underside of the second chair seat. The first chair support may be disposed partially on the underside of the second chair seat.

The second chair may include a fourth chair support. The fourth chair support may include one or more legs. Preferably, the fourth chair support may include two legs. The fourth chair support may be formed from steel, metal, aluminum and/or any other suitable material. The fourth chair support may include a rod. The fourth chair support may extend parallel to the back-to-front axis.

The fourth chair support may be disposed on a second side of the second chair seat. The fourth chair support may be disposed on the underside of the second chair seat. The fourth chair support may be disposed partially on the underside of the second chair seat.

The second chair may include a third bar. The third bar may connect the third chair support and the fourth chair support. The third bar may connect the third chair support to the fourth chair support. The third bar may be formed from steel, metal, aluminum and/or any other suitable material. The third bar may be disposed on the underside of the second chair seat. The third bar may be disposed under a front portion of the second chair seat.

The second chair may include a fourth bar. The fourth bar may connect the third chair support and the fourth chair support. The fourth bar may connect the third chair support to the fourth chair support. The fourth bar may be formed from steel, metal, aluminum and/or any other suitable material. The fourth bar may be disposed on the underside of the second chair seat. The fourth bar may be disposed on a back portion of the underside of the second chair seat.

The second chair may include a second book basket. The second book basket may include steel, metal, aluminum, plastic and/or any other suitable material. The second book basket may include a coating finish. The second book basket may include a powder coat. The second book basket may include any other suitable coat.

The second book basket may be mounted to the second chair. The second book basket may be mounted to the underside of the second chair seat. The second book basket may be installed on an underside of the third chair support and the fourth chair support. A surface of the second book basket may be flush with a surface of the third chair support and a surface of the fourth chair support. The second book basket may be mounted via screws, nuts, bolts, adhesives, welding and/or any other suitable method of mounting. The second book basket may be attachable to the second chair. The second book basket may be removed from the second chair. The second book basket may promote stacking of the second chair with the first chair. The second book basket may promote stacking of the second chair with any other suitable chair.

The second book basket may include a second frame. The second frame may include a third stadium-shaped orifice. The second frame may include a fourth stadium-shaped orifice. The shape of the third stadium-shaped orifice may correspond to the shape of the fourth stadium-shaped orifice.

The third stadium-shaped orifice may include a curvature. The fourth stadium-shaped orifice may include a curvature. The third chair support may include a curvature. The fourth chair support may include a curvature. The curvature of the third stadium-shaped orifice may correspond to the curvature of the third chair support. The curvature of the fourth stadium-shaped orifice may correspond to the curvature of the fourth chair support. The curvature of the third chair support may correspond to the curvature of the fourth chair support.

The second frame may include a second plurality of connectors. The second plurality of connectors may connect the third stadium-shaped orifice to the fourth stadium-shaped orifice. The second plurality of connectors may be straight connectors. The connectors may provide a surface within the second book basket. As such, one or more items may rest within the second book basket.

The second book basket may include a second blocker. The second blocker may be disposed within either the third stadium-shaped orifice or the fourth stadium-shaped orifice. As such, the stadium-shaped orifice that does not include the blocker may enable insertion and removal of the one or more items. The stadium-shaped orifice that includes a blocker may prevent the one or more items from falling out of the book basket.

The second blocker may include a horizontal wire. The second blocker may include two horizontal wires. As such, the second blocker may run parallel to the back-to-front axis. The second blocker may include a vertical wire. The second blocker may include two horizontal wires. As such, the second blocker may run perpendicular to the back-to-front axis. In some embodiments, the second blocker may be horizontal and vertical. The second blocker may include any other suitable shape.

The second book basket may include a second plurality of spacers. Preferably, the second book basket may include four spacers. The second book basket may include any other suitable number of spacers. The second plurality of spacers may be disposed on a portion of the second plurality of connectors located on an underside of the second book basket. The second plurality of spacers may provide a portion of space between the first chair and the second chair, when the chair is vertically stacked with another chair. The second book basket may enable vertical stacking of four chairs per linear yard.

The second book basket may be installed with the fourth stadium-shaped orifice on the first side of the second chair seat. The second book basket may be installed with the fourth stadium-shaped orifice on the second side of the chair seat. The one or more items may be inserted and removed at the first side of the second chair seat. The one or more items may be inserted and removed on the second side of the second chair seat.

It should be noted that the first chair may be stacked on top of the second chair. When the first chair is stacked on top of the second chair, the first book basket may be on top of the second chair seat. The first plurality of stoppers may prevent the first chair from touching the second chair.

BRIEF DESCRIPTION OF THE DRAWINGS

The objects and advantages of the disclosure will be apparent upon consideration of the following detailed description, taken in conjunction with the accompanying drawings, in which like reference characters refer to like parts throughout, and in which.

Figure 1:
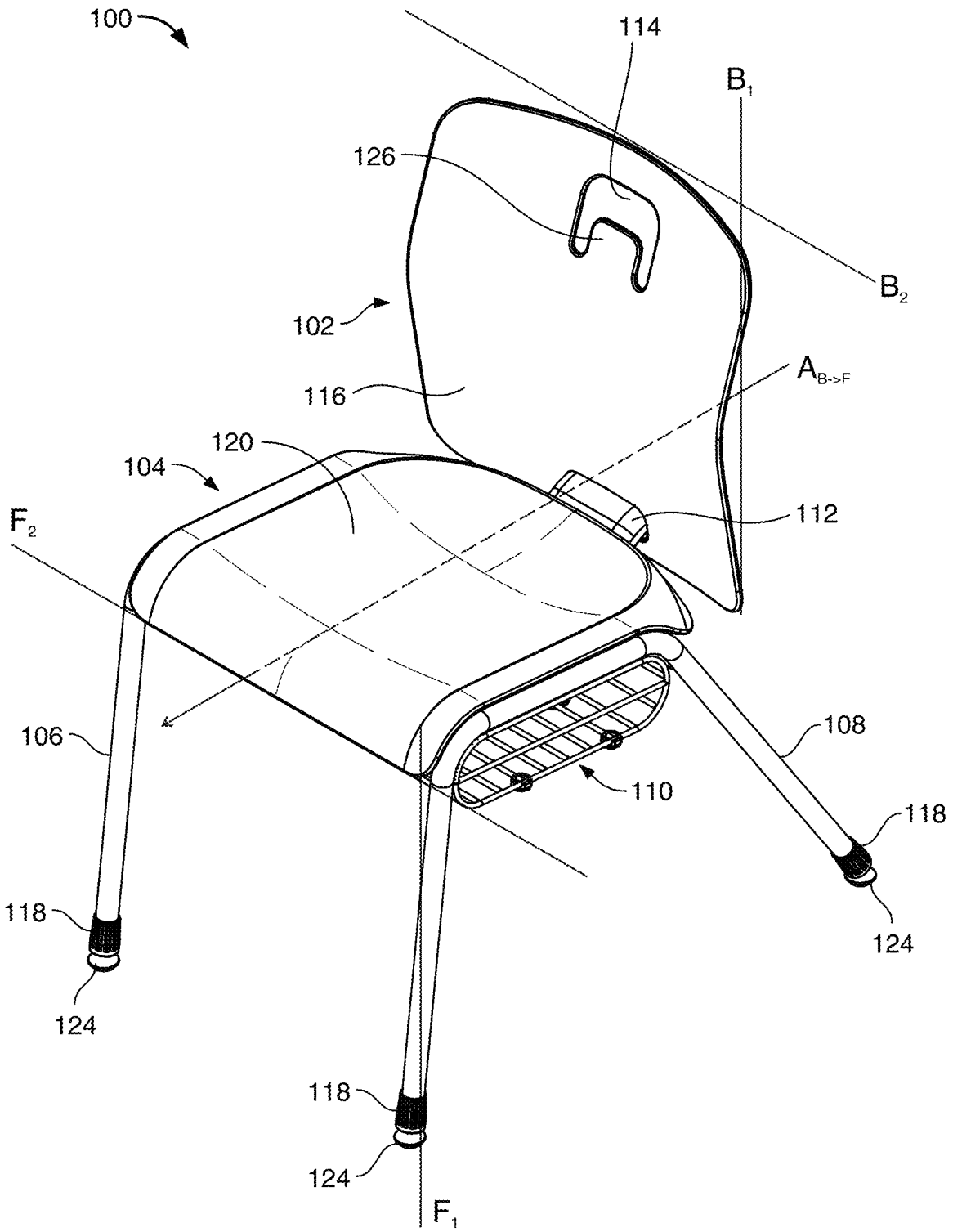
FIG. 1 shows an illustrative apparatus in accordance with principles of this matter.

The leftmost digit (e.g., "L") of a three-digit reference numeral (e.g., "LRR"), and the two leftmost digits (e.g., "LL") of a four-digit reference numeral (e.g., "LLRR"), generally identify the first figure in which a part is called-out.

DETAILED DESCRIPTION OF THE DISCLOSURE

A chair is provided. The chair may include a chair back. The chair may include a chair seat. The chair may include a steel bracket. The chair may include a first chair support. The chair may include a second chair support. The chair may include a first bar. The chair may include a second bar. The chair may include a book basket.

The chair may include a chair back. The chair back may include a poly-molded material. The chair back may house a plate. The chair back may be molded around the plate. The plate may include steel, aluminum, metal and/or any other suitable material.

The chair back may define a first aperture. The first aperture may expose at least a portion of a face of the plate. The first aperture may be defined within a lower portion of the chair back.

The chair may include a chair seat. The chair seat may include a poly-molded material. The chair seat may define a back-to-front axis. The back-to-front axis may be defined with respect to the chair back. As such, the back-to-front axis may run from the back of the chair to the front of the chair.

The chair seat may define a second aperture. The second aperture may be defined within the back of the chair seat. The second aperture may be engaged with a bracket.

The chair may include a bracket. The bracket may include steel, aluminum, metal and/or any other suitable material. The bracket may connect an underside of the chair seat to the plate. The bracket may extend through the second aperture. As such, the bracket may connect the chair seat to the chair back.

The chair may include a first chair support. The first chair support may include one or more legs. Preferably, the first chair support may include two legs. The first chair support may be formed from steel, metal, aluminum and/or any other suitable material. The first chair support may be formed from any other suitable material. The first chair support may include a rod. The first chair support may extend parallel to the back-to-front axis.

The first chair support may be disposed on a first side of the chair seat. The first chair support may be disposed on the underside of the chair seat. The first chair support may be disposed partially on the underside the chair seat.

The chair may include a second chair support. The second chair support may include one or more legs. Preferably, the second chair support may include two legs. The second chair support may be formed from steel. The second chair support may be formed from any other suitable material. The second chair support may include a rod. The second chair support may extend parallel to the back-to-front axis.

The second chair support may be disposed on a second side of the chair seat. The second chair support may be disposed on the underside of the chair seat. The second chair support may be disposed partially on the underside of the chair seat.

The chair may include a first bar. The first bar may connect the first chair support and the second chair support. The first bar may connect the first chair support to the second chair support. The first bar may be formed from steel, metal, aluminum and/or any other suitable material. The first bar may be disposed on the underside of the chair seat. The first bar may be disposed on a front portion of the underside of the chair seat.

The chair may include a second bar. The second bar may connect the first chair support and the second chair support. The second bar may connect the first chair support to the second chair support. The second bar may be formed from steel, metal, aluminum and/or any other suitable material. The second bar may be disposed on the underside of the chair seat. The second bar may be disposed on a back portion of the underside of the chair seat.

The chair may include a book basket. The book basket may include steel, metal, aluminum, plastic and/or any other suitable material. The book basket may include a coating finish. The book basket may include a powder coat. The book basket may include any other suitable coat.

The book basket may be mounted to the chair. The book basket may be mounted to the underside of the chair seat. The book basket may be installed on the underside of the first chair support and the second chair support. A surface of the book basket may be flush with a surface of the first chair support and a surface of the second chair support. The book basket may be mounted via screws, nuts, bolts, adhesives, welding and/or any other suitable method of mounting. The book basket may be attachable to the chair. The book basket may be removed from the chair. The book basket may promote stacking of the chair.

The book basket may include a frame. The frame may include a first stadium-shaped orifice. The frame may include a second stadium-shaped orifice. The shape of the first stadium-shaped orifice may correspond to the shape of the second stadium-shaped orifice.

The first stadium-shaped orifice may include a curvature. The second stadium-shaped orifice may include a curvature. The first chair support may include a curvature. The second chair support may include a curvature. The curvature of the first stadium-shaped orifice may correspond to the curvature of the first chair support. The curvature of the second stadium-shaped orifice may correspond to the curvature of the second chair support. The curvature of the first chair support may correspond to the curvature of the second chair support.

The frame may include a plurality of connectors. The plurality of connectors may connect the first stadium-shaped orifice to the second stadium-shaped orifice. The plurality of connectors may be straight connectors. The connectors may provide a surface within the book basket. As such, one or more items may rest within the book basket.

The book basket may include a blocker. The blocker may be disposed either within the first stadium-shaped orifice or within the second stadium-shaped orifice. As such, the stadium-shaped orifice that does not include the blocker may enable insertion and removal of the one or more items. The stadium-shaped orifice that includes the blocker may prevent the one or more items from falling out of the book basket.

The blocker may include a horizontal wire. The blocker may include two horizontal wires. As such, the blocker may run parallel to the back-to-front axis. The blocker may include a vertical wire. The blocker may include two horizontal wires. As such, the blocker may run perpendicular to the back-to-front axis. In some embodiments, the blocker may be horizontal and vertical. The blocker may include any other suitable shape.

The book basket may include a plurality of spacers. Preferably, the book basket may include four spacers. The book basket may include any other suitable number of spacers. The plurality of spacers may be disposed on a portion of the plurality of connectors located on an underside of the book basket. The plurality of spacers may provide a portion of space between each chair when the chair is vertically stacked with another chair. The book basket may enable vertical stacking of four chairs per linear yard.

Apparatus and methods described herein are illustrative. Apparatus and methods in accordance with this disclosure will now be described in connection with the figures, which form a part hereof. The figures show illustrative features of apparatus and method steps in accordance with the principles of this disclosure. It is understood that other embodiments may be utilized, and that structural, functional, and procedural modifications may be made without departing from the scope and spirit of the present disclosure. The steps of methods may be performed in an order other than the order shown and/or described herein. Embodiments may omit steps shown and/or described in connection with illustrative methods. Embodiments may include steps that are neither shown nor described in connection with illustrative methods.

Illustrative method steps may be combined. For example, an illustrative method may include steps shown in connection with another illustrative method.

Apparatus may omit features shown and/or described in connection with illustrative apparatus. Embodiments may include features that are neither shown nor described in connection with the illustrative apparatus. Features of illustrative apparatus may be combined. For example, an illustrative embodiment may include features shown in connection with another illustrative embodiment.

The drawings show illustrative features of apparatus and methods in accordance with the principles of the invention. The features are illustrated in the context of selected embodiments. It will be understood that features shown in connection with one of the embodiments may be practiced in accordance with the principles of the invention along with features shown in connection with another of the embodiments.

One of ordinary skill in the art will appreciate that the steps shown and described herein may be performed in other than the recited order and that one or more steps illustrated may be optional. The methods of the above-referenced embodiments may involve the use of any suitable elements, steps, computer-executable instructions, or computer-readable data structures. In this regard, other embodiments are disclosed herein as well that can be partially or wholly implemented on a computer-readable medium, for example, by storing computer-executable instructions or modules or by utilizing computer-readable data structures. For example, methods for producing an apparatus may, in certain embodiments, be wholly or partially executed by designing the apparatus via software, such as computer aided design (CAD) software.

All ranges and parameters disclosed herein shall be understood to encompass any and all subranges subsumed therein, every number between the endpoints, and the endpoints. For example, a stated range of "1 to 10" should be considered to include any and all subranges between (and inclusive of) the minimum value of 1 and the maximum value of 10; that is, all subranges beginning with a minimum value of 1 or more (e.g. 1 to 6.1), and ending with a maximum value of 10 or less (e.g., 2.3 to 10.4, 3 to 8, 4 to 7), and finally to each number 1, 2, 3, 4, 5, 6, 7, 8, 9, and 10 contained within the range.

The classroom chair may include a plurality of different sized classroom chairs. Each size included in the plurality of sizes may include dimensions, as described herein. The dimensions included in the plurality of sizes may be proportional to each other.

FIG. 1 shows illustrative classroom chair 100. Classroom chair 100 may include chair back 102. Chair back 102 may define back axis $B_1$. Chair back 102 may define back axis $B_2$. Back axis $B_1$ and back axis $B_2$ may define a back plane.

Classroom chair 100 may include chair seat 104. Chair seat 104 may define front axis $F_1$. Chair seat 104 may define front axis $F_2$. Front axis $F_1$ and front axis $F_2$ may define a front plane.

Classroom chair 100 may define back-to-front axis $A_{B\rightarrow F}$. Back-to-front axis $A_{B\rightarrow F}$ may extend from the back plane to the front plane. Chair seat 104 may be connected to chair back 102 via bracket 112. Bracket 112 may be a steel bracket. Bracket 112 may be any suitable bracket. Bracket 112 may extend along back-to-front axis $A_{B\rightarrow F}$.

Chair back 102 may include front surface 116. Chair seat 104 may include seat pan 120. When a user sits on classroom chair 100, the user may engage front surface 116 and seat pan 120.

Classroom chair 100 may include chair support 106. Chair support 106 may be mounted to an underside of chair seat 104. Chair support 106 may be mounted via welding, screws, adhesives and/or any other suitable form of attachment. Chair support 106 may extend along back-to-front axis $A_{B\rightarrow F}$.

Classroom chair 100 may include chair support 108. Chair support 108 may be mounted to the underside of chair seat 104. Chair support 108 may be mounted via welding, screws, adhesives and/or any other suitable form of attachment. Chair support 108 may extend along back-to-front axis $A_{B\rightarrow F}$.

When chair support 106 is mounted to the underside of chair seat 104 and chair support 108 is mounted to the underside of chair seat 104, chair support 106 may be parallel to chair support 108. When chair support 106 is mounted to the underside of chair seat 104 and chair support 108 is mounted to the underside of chair seat 104, chair support 106, chair support 108 and bracket 112 may be parallel to each other.

Classroom chair 100 may include boots 118. Boots 118 may be disposed near bottoms of chair support 106 and chair support 108. Classroom chair 100 may include glides 124. Glides 124 may be disposed under bottoms of chair support 106 and chair support 108.

Classroom chair 100 may include book basket 110. Book basket 110 may be attached to the underside of chair seat 104. Book basket 110 may be mounted to the underside of chair seat 104. When book basket 110 is attached to the underside of chair seat 104, book basket 110 may rest flush with an underside of chair support 106 and an underside of chair support 108.

Chair back 102 may define cavity 114. Cavity 114 may be a U-shaped cavity. Cavity 114 may define protrusion 126. Protrusion 126 may be used to hang a book bag, a jacket and/or any other suitable item. Cavity 114 may be used as a handle. Cavity 114 may be used to lift and/or carry classroom chair 100.

Figure 2:
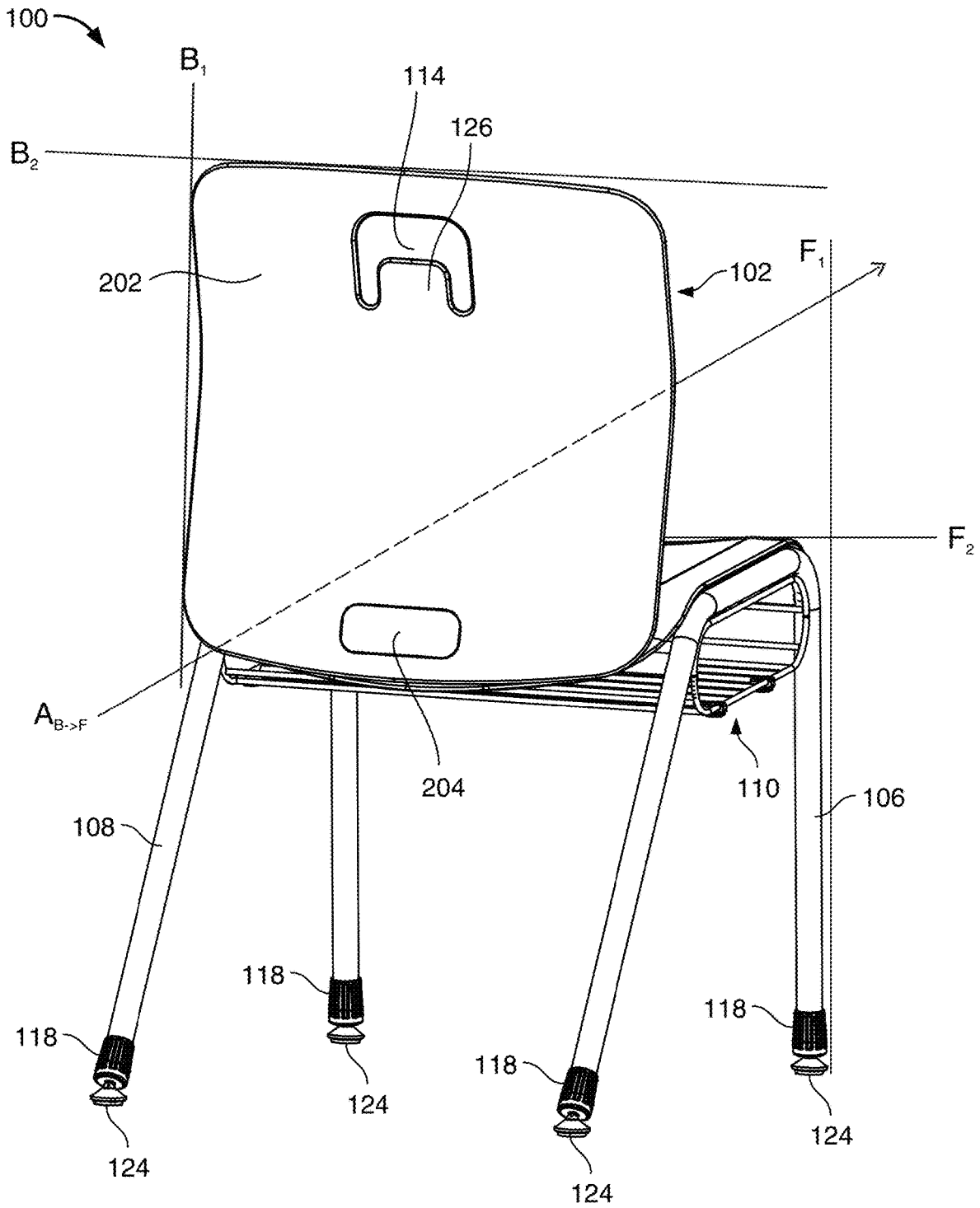
FIG. 2 shows another illustrative apparatus in accordance with principles of this matter.

FIG. 2 shows a back view of classroom chair 100.

Chair back 102 may include back surface 202. Chair back 102 may define an aperture (not shown). Chair back 102 may include cover 204. Cover 204 may be used to cover the aperture.

Figure 3:
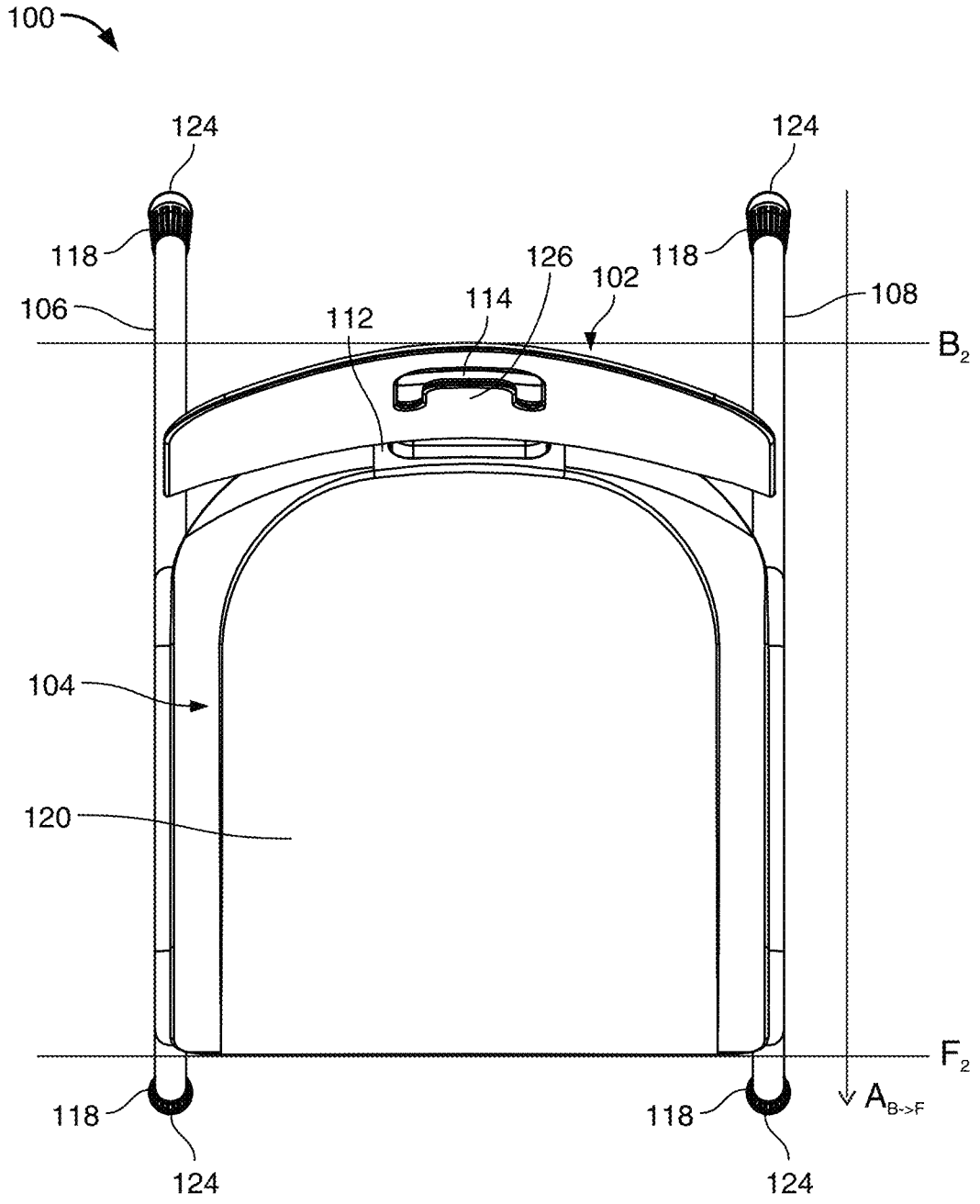
FIG. 3 shows yet another illustrative apparatus in accordance with principles of this matter.

FIG. 3 shows a top view of classroom chair 100.

Figure 4:
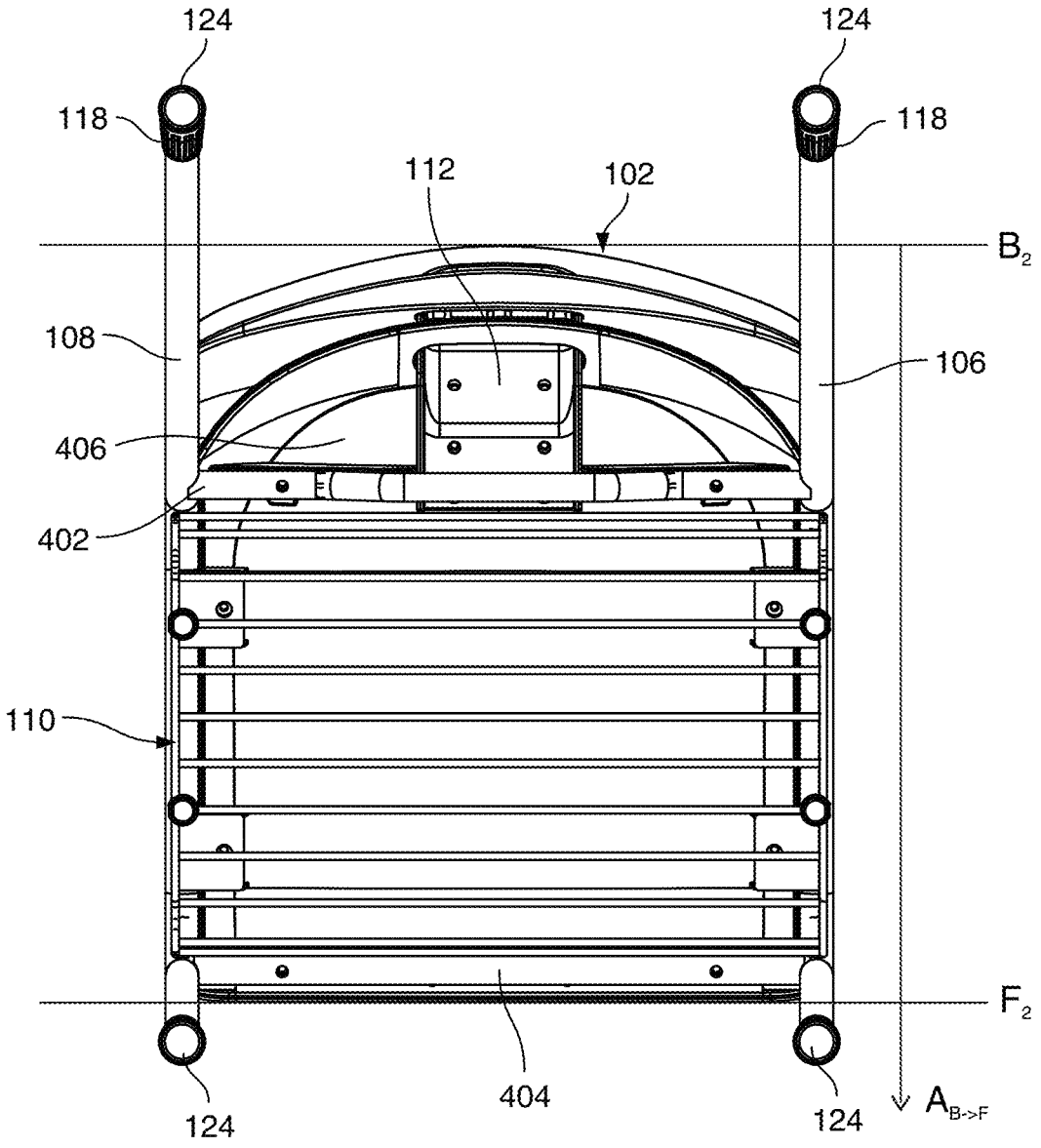
FIG. 4 shows still another illustrative apparatus in accordance with principles of this matter.

FIG. 4 shows a bottom view of classroom chair 100.

Chair seat 104 may include underside 406. Chair support 106 may be mounted to underside 406. Chair support 108 may be mounted to underside 406. Book basket 110 may be mounted to underside 406.

Classroom chair 100 may include bar 402. Bar 402 may be mounted to chair support 106 and chair support 108. Bar 402 may be mounted via welding, adhesives, screws and/or any other suitable attachment mechanism. Bar 402 may extend from chair support 106 to chair support 108. Bar 402 may be mounted at a location that is located towards the back plane. Bar 402 may include angular dips. The angular dips may enable bar 402 to extend around bracket 112. The angular dips may enable bar 402 to extend from chair support 106 to chair support 108 without interfering with bracket 112.

Classroom chair 100 may include bar 404. Bar 404 may be mounted to chair support 106 and chair support 108. Bar 404 may be mounted via welding, adhesives, screws and/or any other suitable attachment mechanism. Bar 404 may extend from chair support 106 to chair support 108. Bar 404 may be mounted at a location that is located towards the front plane.

Bar 404 may be parallel to bar 402. Bar 404 and bar 402 may be substantially perpendicular to chair support 106 and chair support 108.

Figure 5:
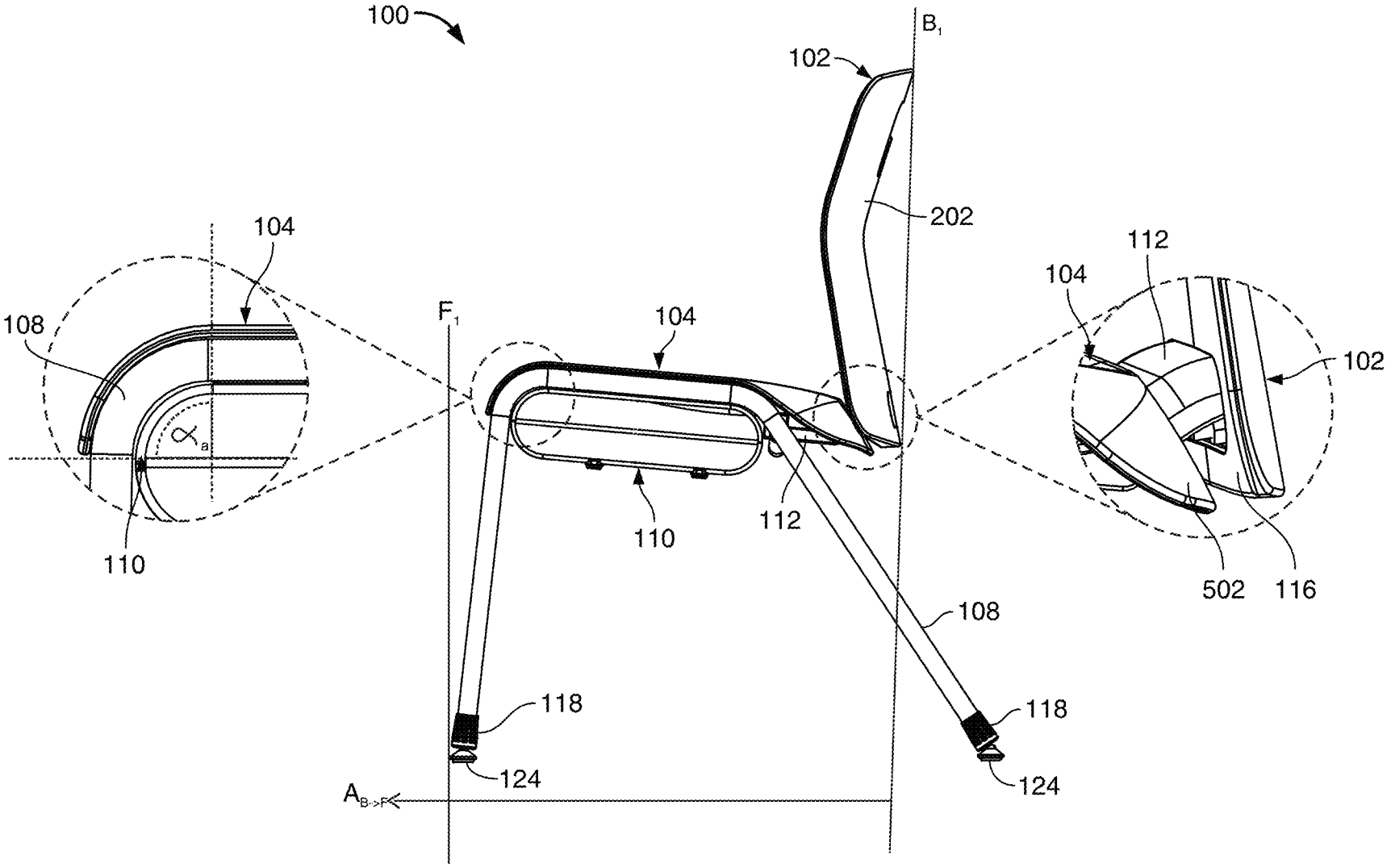
FIG. 5 shows an illustrative apparatus in accordance with principles of this matter.

FIG. 5 shows a side view of classroom chair 100.

Chair seat 104 may include a first curvature. Chair support 108 may include a second curvature. Book basket 110 may include a third curvature. The first curvature, the second curvature and the third curvature may define angle $\alpha_a$. Table 2 shows illustrative angle ranges that may include angle $\alpha_a$.

TABLE 2

| Illustrative angle ranges. Illustrative angle ranges. |
|---|
| <20° |
| 20°-40° |
| 40°-60° |
| 60°-80° |
| 80°-100° |
| >100° |
| Other suitable angle ranges |

For example, angle $\alpha_a$. may be an angle of 90°. Angle $\alpha_a$. may be an angle that is slightly larger than 90°. Angle $\alpha_a$. may be an angle that is slightly smaller than 90°. Angle $\alpha_a$ may be any suitable angle.

Chair seat 104 may include lip 502. Lip 502 may extend towards the back plane. Lip 502 may extend below a plane defined by seat pan 120. Lip 502 may include a convex surface. A bottom portion of front surface 116 may have a concave surface. The concave surface may conform to the convex surface.

Figure 6:
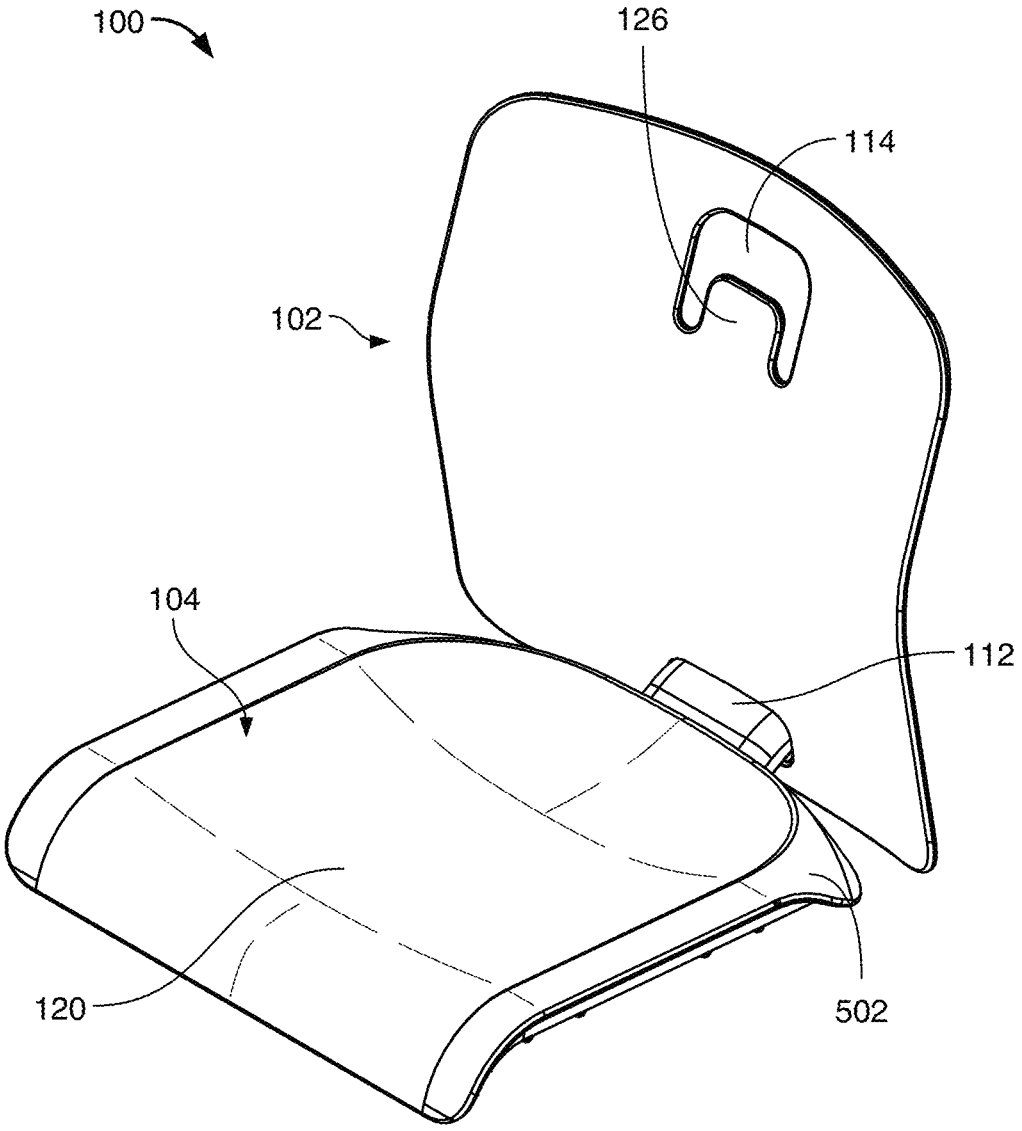
FIG. 6 shows another illustrative apparatus in accordance with principles of this matter.

FIG. 6 shows chair seat 104 coupled to chair back 102 via bracket 112.

Figure 7:
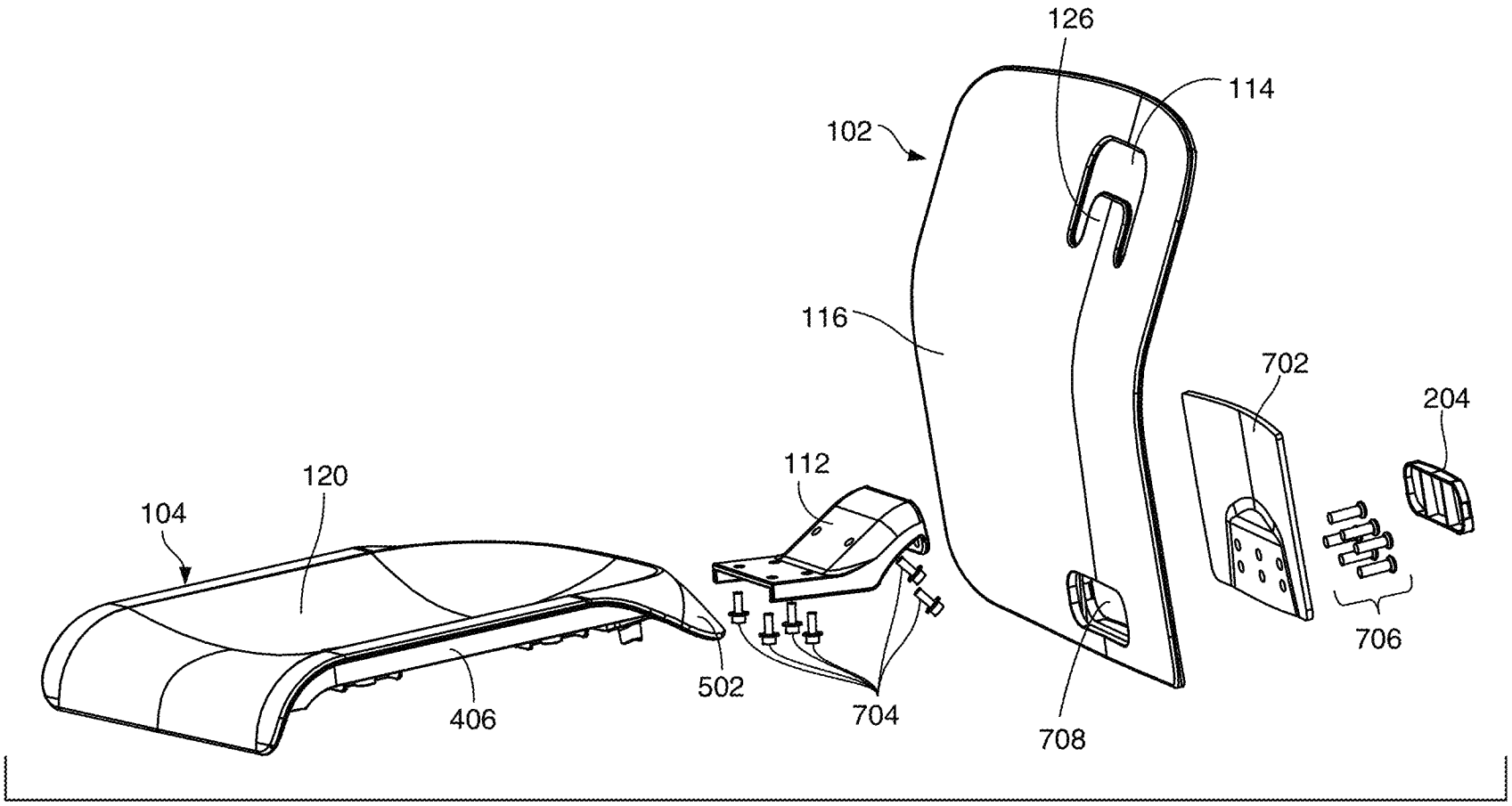
FIG. 7 shows yet another illustrative apparatus in accordance with principles of this matter.

FIG. 7 shows an exploded view of chair seat 104 coupled to chair back 102 via bracket 112.

Chair back 102 may house steel plate 702. Steel plate 702 may be attached to bracket 112 via screws 706. Cover 204 may cover screws 706 when screws 706 attach steel plate 702 to bracket 112. Bracket 112 may be attached to underside 406 of chair seat 104 via screws 704.

Chair back 102 may define cavity 708. Cavity 708 may extend through a thickness of chair back 102. Cavity 708 may expose steel plate 702 when steel plate is housed in chair back 102.

Figure 8A:
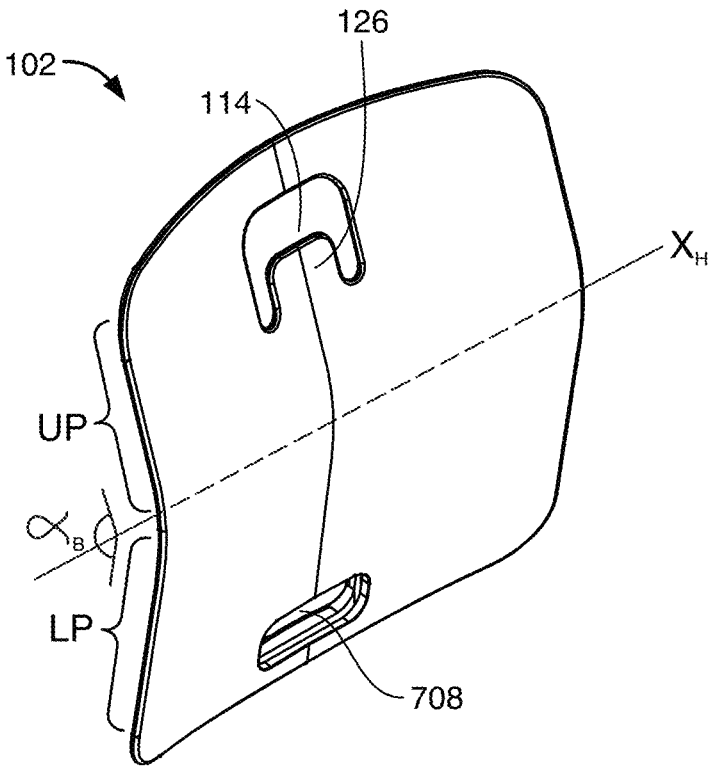
FIGS. 8A-8F show still another illustrative apparatus in accordance with principles of this matter.

FIG. 8A shows a front view of chair back 102.

Chair back 102 may define horizontal axis $X_H$. Horizontal axis $X_H$ may define upper portion UP of chair back 102. Horizontal axis $X_H$ may define lower portion LP of chair back 102. Horizontal axis $X_H$ may define a linear bend. The linear bend may separate upper portion UP from lower portion LP. The linear bend may define angle $\alpha_B$. Table 3 shows illustrative angle ranges that may include angle $\alpha_B$.

TABLE 3

| Illustrative angle ranges. Illustrative angle ranges. |
|---|
| <25° |
| 25°-50° |
| 50°-75° |
| 75°-100° |
| 100°-125° |
| 125°-150° |
| 150°-175° |
| >175° |
| Illustrative angle |

TABLE 3-continued

| Illustrative angle ranges. Illustrative angle ranges. |
|---|
| ranges. Other suitable angle ranges |

For example, angle $\alpha_B$ may be an angle of 152°. Angle $\alpha_B$ may be an angle of 152.81°. Angle $\alpha_B$ may be any suitable angle.

Figure 8B:
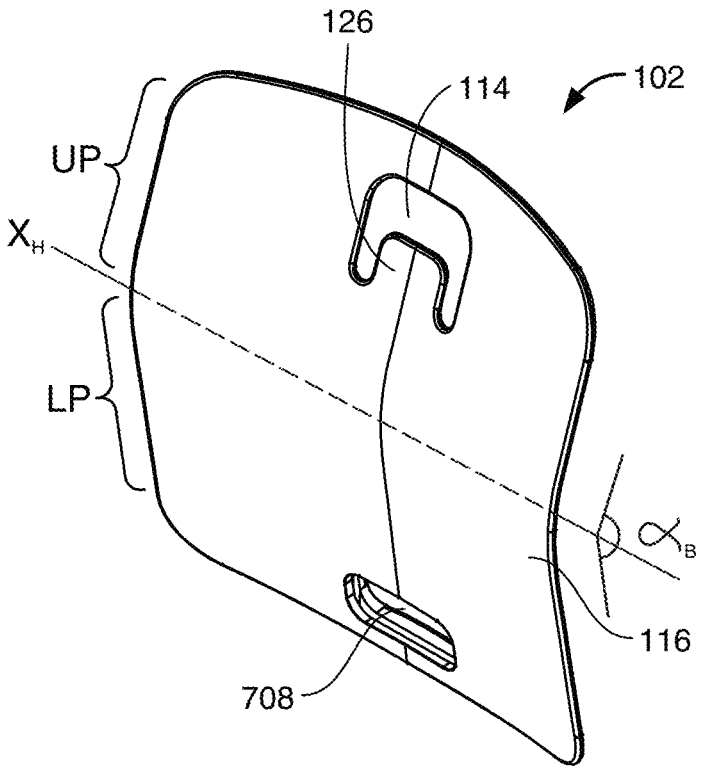

FIG. 8B shows another front view of chair back 102.

Figure 8C:
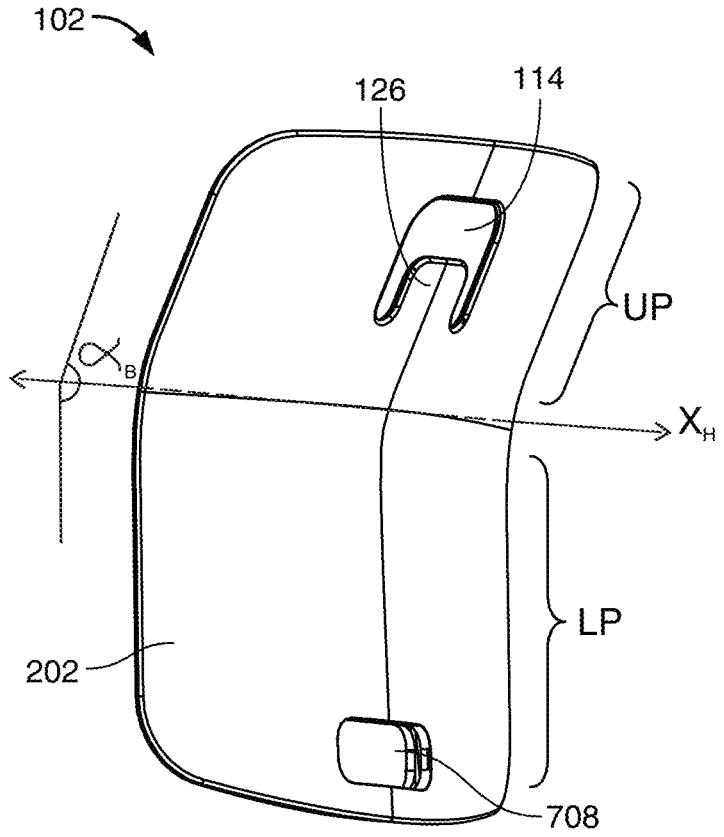

FIG. 8C shows a back view of chair back 102.

Figure 8D:
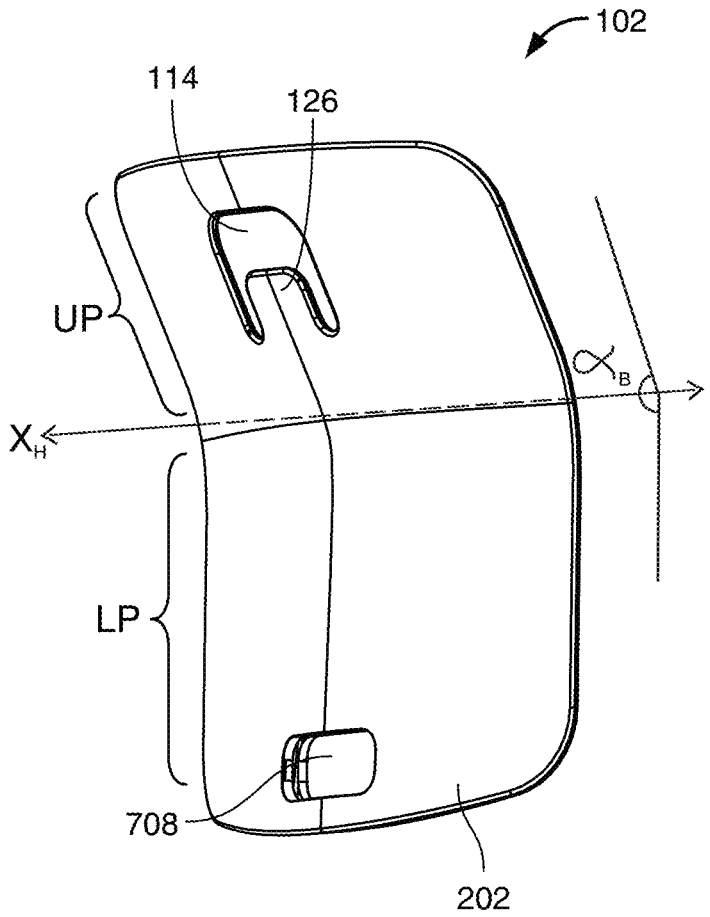

FIG. 8D shows another back view of chair back 102.

Figure 8F:
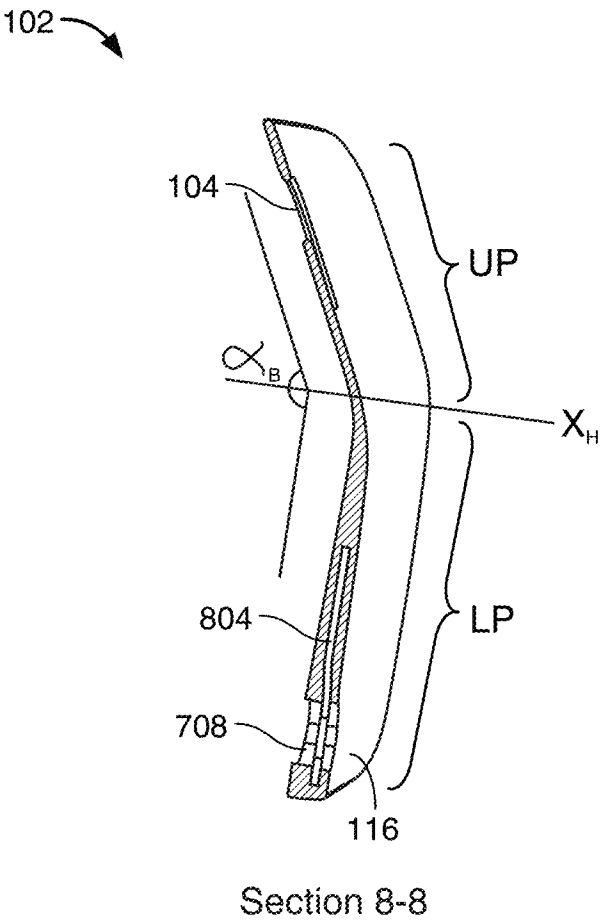
Figure 8E:
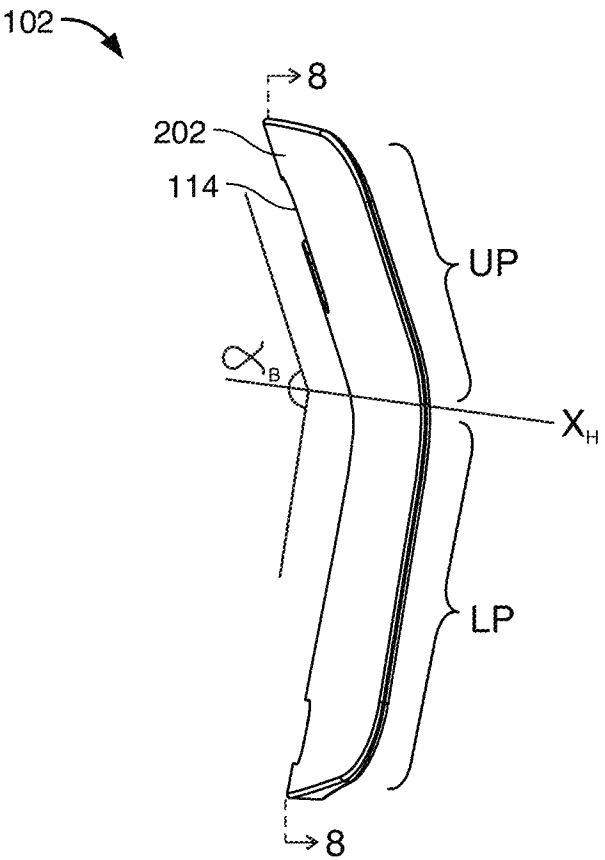

FIG. 8E shows a side view of chair back 102.

FIG. 8F shows a cross section of chair back 102 taken along view lines 8-8.

Chair back 102 may define socket 804. Socket 804 may include an open space within chair back 102. Socket 804 may house steel plate 702.

Figure 9B:
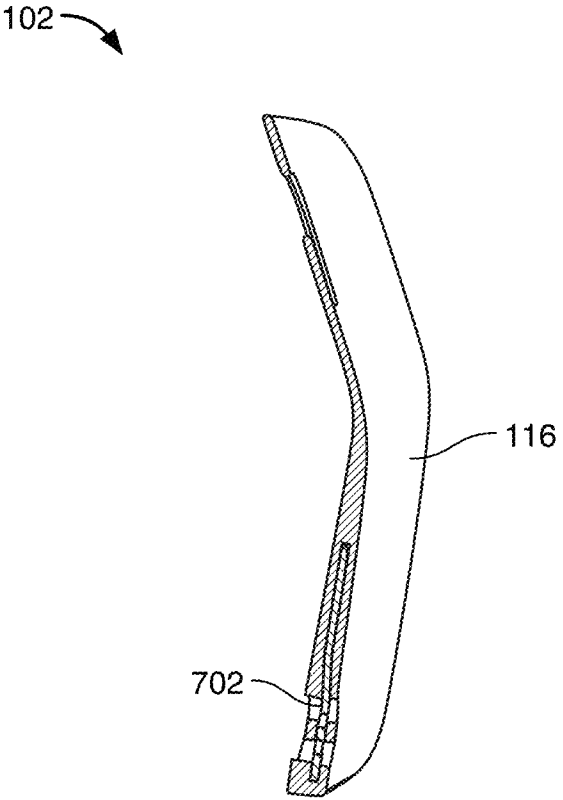
FIGS. 9A-9B show an illustrative apparatus in accordance with principles of this matter.
Figure 9A:
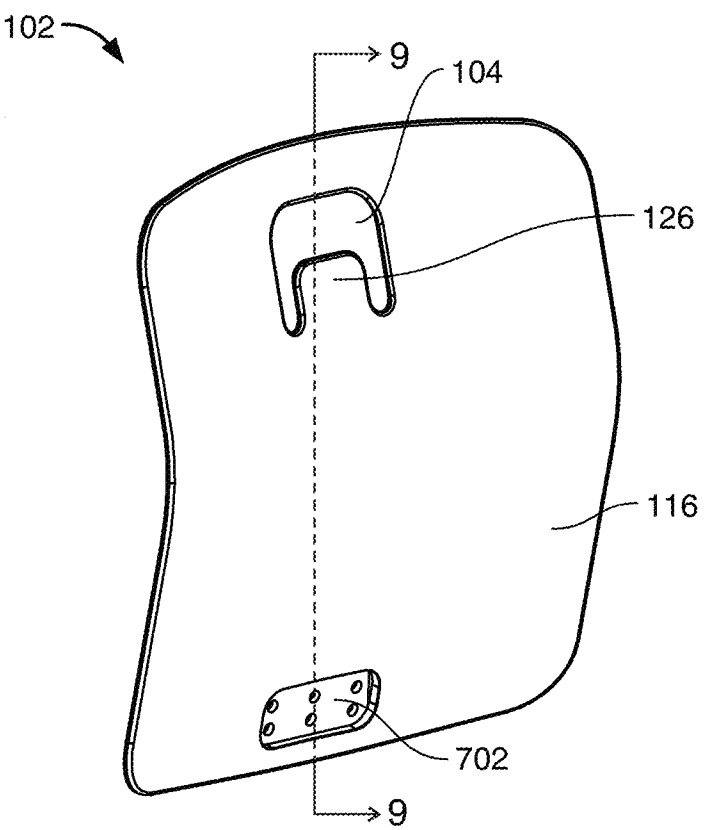

FIG. 9A shows chair back 102 with steel plate 702 housed in socket 804. When steel plate 702 is housed in socket 804, cavity 708 may expose a portion of steel plate 702.

FIG. 9B shows a cross-sectional view of chair back 102 with steel plate 702 housed in socket 804, taken along view lines 9-9.

Figure 10A:
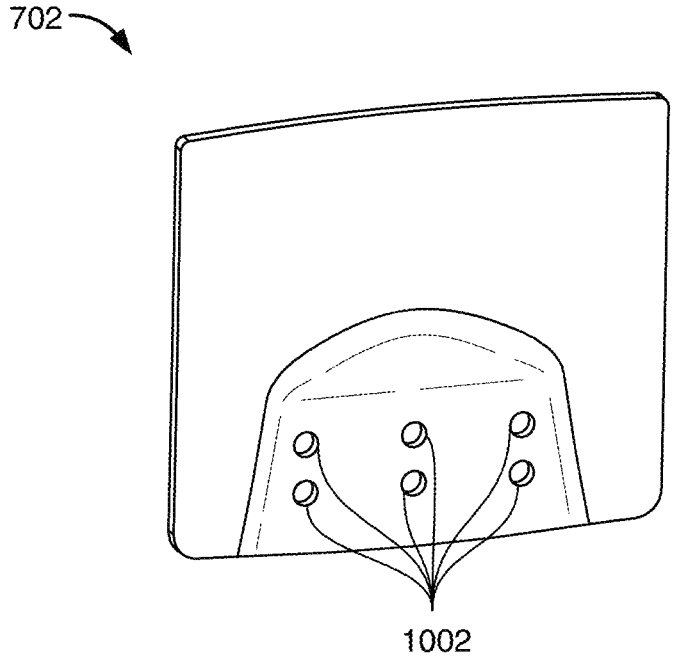
FIGS. 10A-10B show another illustrative apparatus in accordance with principles of this matter.

FIG. 10A shows a front view of steel plate 702.

Steel plate 702 may include apertures 1002. Each aperture include in apertures 1002 may receive one of screws 706. Each of apertures 1002 may receive one of screws 706 to attach steel plate 702 to bracket 112. Bracket 112 may define apertures (shown in FIGS. 12A and 12B). Each aperture defined by bracket 112 may receive one of screws 706. Each of screws 706 may have a corresponding nut. Each screw from screws 706 may be placed through an aperture included in apertures 1002 and a corresponding aperture included in bracket 112. Each nut may be used to secure a corresponding one of screws 706.

Figure 10B:
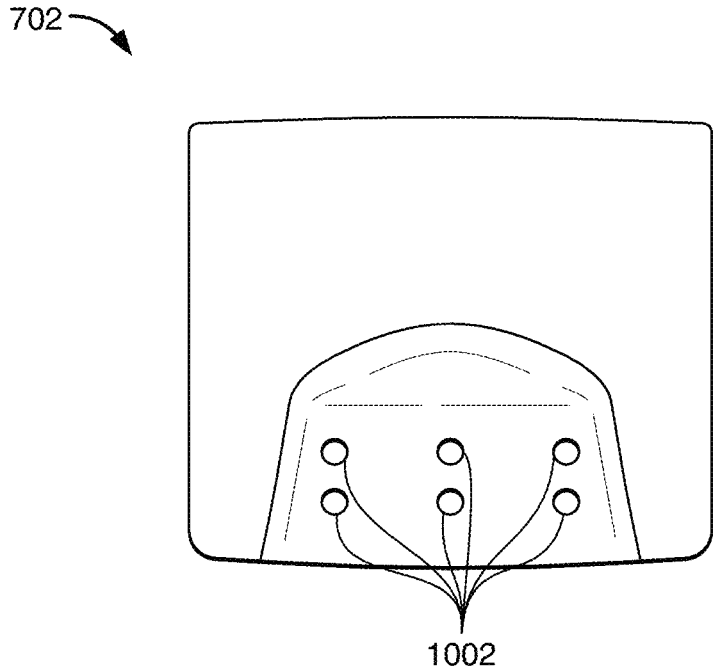

FIG. 10B shows a back view of steel plate 702.

Figure 11A:
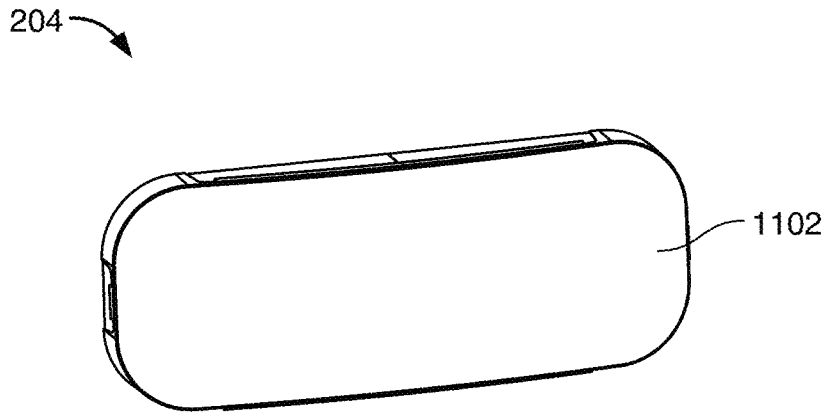
FIGS. 11A-11B show yet another illustrative apparatus in accordance with principles of this matter.

FIG. 11A shows a back view of cover 204.

Cover 204 may be a lock-tight cover. When cover 204 covers cavity 708, surface 1102 may be visible to a user.

Figure 11B:
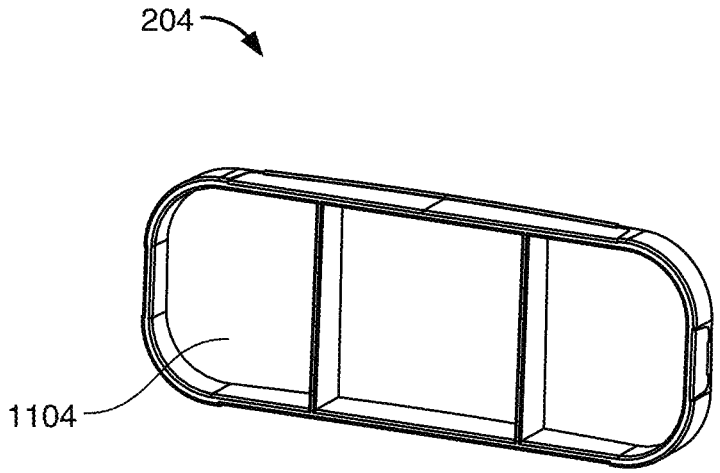

FIG. 11B shows a front view of cover 204.

When cover 204 covers cavity 708, inside 1104 may not be visible to a user.

Figure 12A:
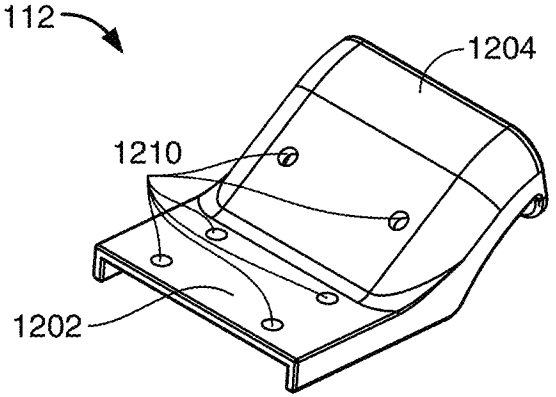
FIGS. 12A-12D show still another illustrative apparatus in accordance with principles of this matter.

FIG. 12A shows a perspective view of bracket 112.

Bracket 112 may include curved portion 1204. Bracket 112 may include flat portion 1202. Flat portion 1202 may define apertures 1210. Each of apertures 1210 may receive one of screws 704. Each of apertures 1210 may receive one of screws 704 to attach bracket 112 to underside 406 of chair seat 104. Underside 406 may define receptacles (shown in FIG. 13B). Each receptacle defined by underside 406 may receive one of screws 704. Screws 704 may be set screws. Each of screws 704 may have a tight fit in a corresponding receptacle from the receptacles defined by underside 406.

Figure 12B:
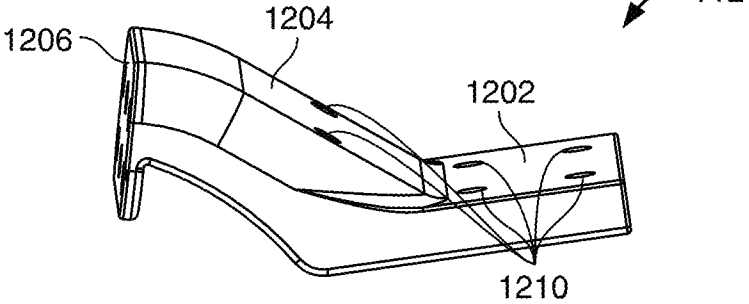

FIG. 12B shows side view of bracket 112. Bracket 112 may include back side 1206.

Figure 12C:
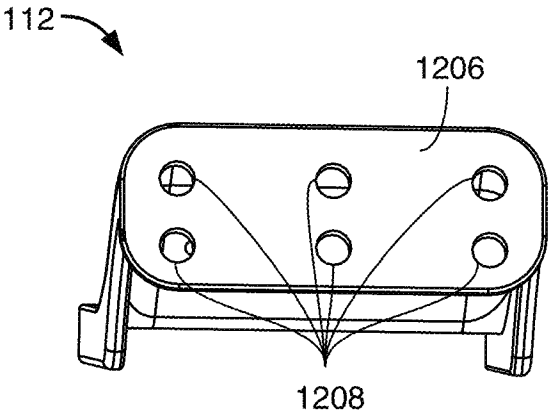

FIG. 12C shows a back view of bracket 112. Back side 1206 may define apertures 1208. Each aperture included in apertures 1208 may correspond to an aperture included in apertures 1002. Each screw from screws 706 may be placed through an aperture included in apertures 1002 and a corresponding aperture included in apertures 1208.

Figure 12D:
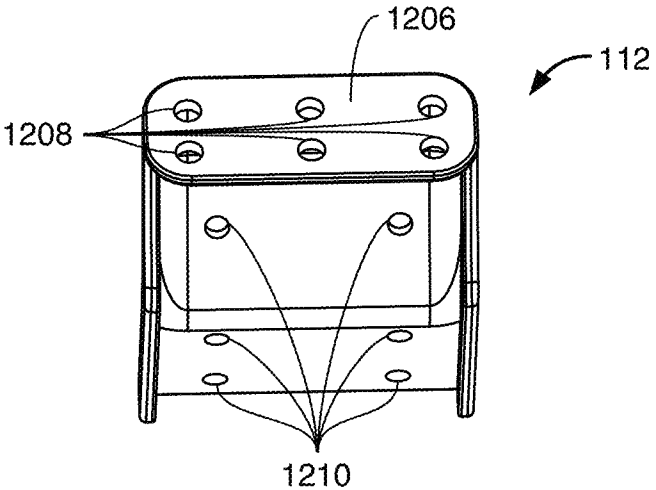

FIG. 12D shows a bottom view of bracket 112.

Figure 13C:
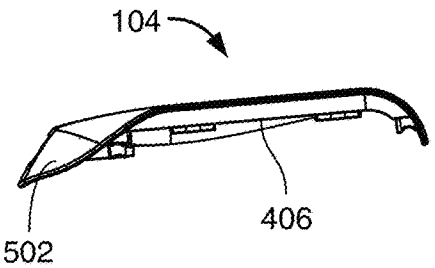
FIGS. 13A-13D show an illustrative apparatus in accordance with principles of this matter.
Figure 13B:
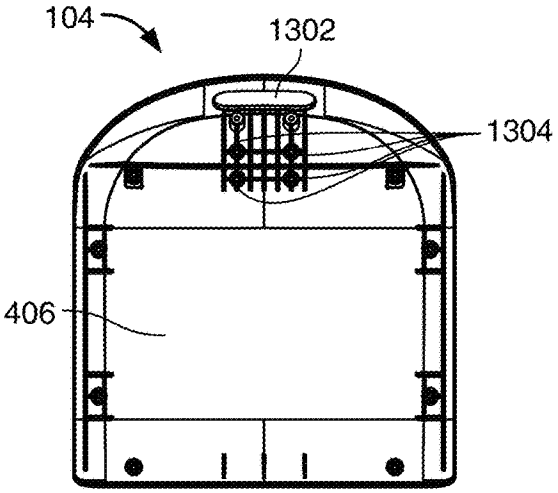
Figure 13D:
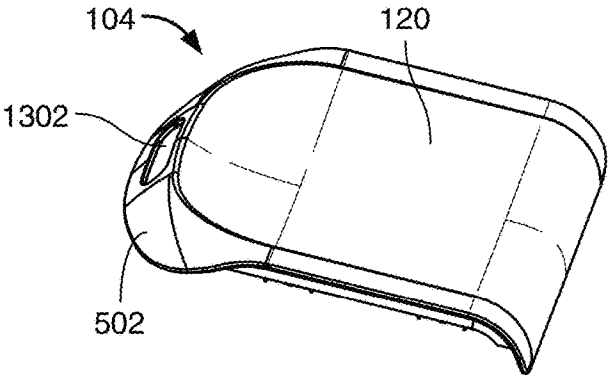
Figure 13A:
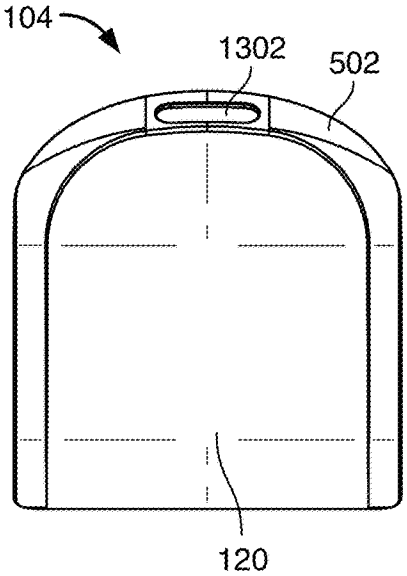

FIG. 13A shows a top view of chair seat 104.

Chair seat 104 may define aperture 1302. Bracket 112 may extend through aperture 1302. Bracket 112 may extend through aperture 1302 to connect to underside 406.

FIG. 13B shows a bottom view of chair seat 104.

Underside 406 defines receptacles 1304. Each receptacle included in receptacles 1304 may receive one of screws 704. Screws 704 may attach flat portion 1202 of bracket 112 to underside 406.

FIG. 13C shows a side view of chair seat 104.

FIG. 13D shows a perspective view of chair seat 104.

Figure 14:
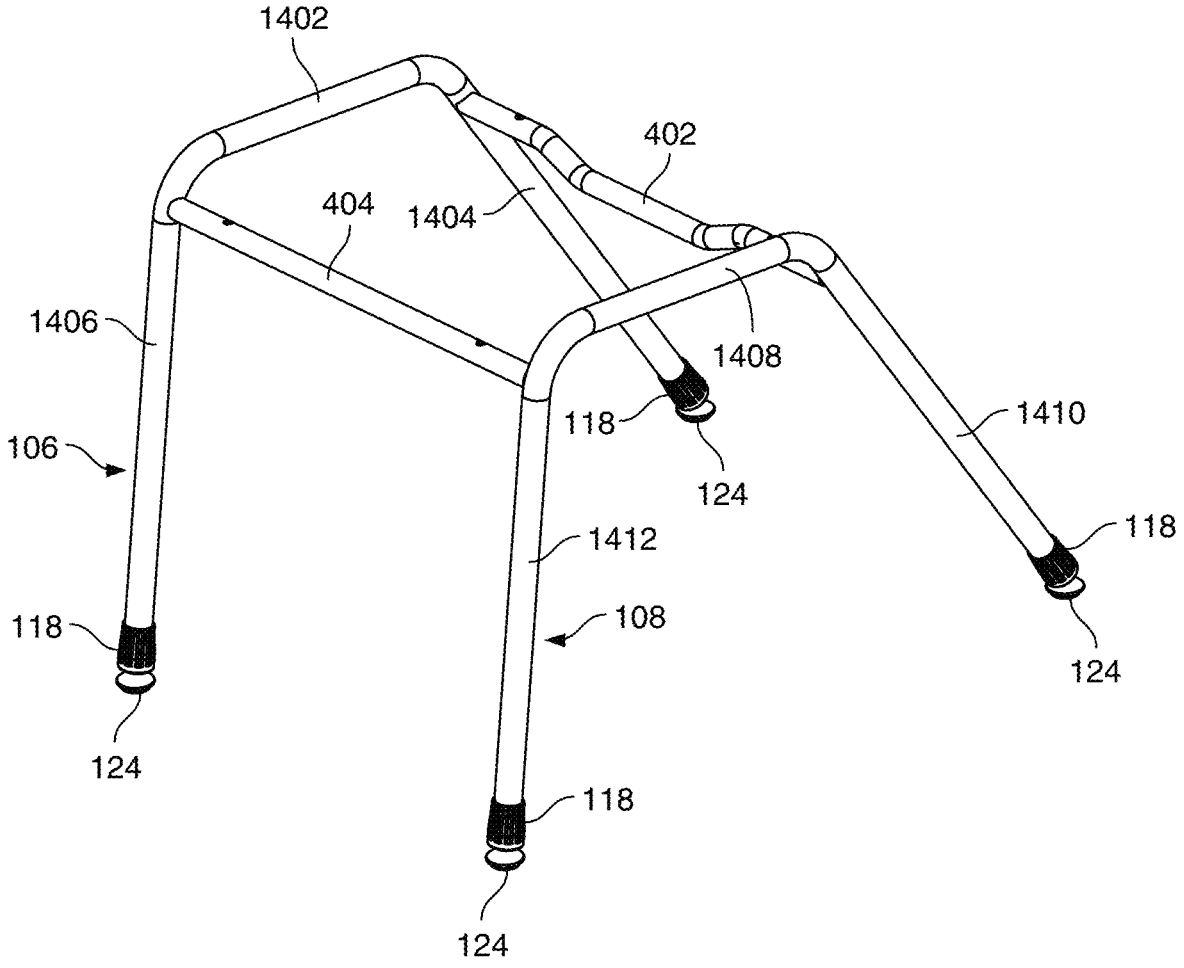
FIG. 14 shows another illustrative apparatus in accordance with principles of this matter.

FIG. 14 shows chair support 106 connected to chair support 108 via bar 402 and bar 404.

Chair support 108 may include stretcher 1408. Chair support 108 may include front leg 1412. Chair support 108 may include back leg 1410. Chair support 106 may include stretcher 1402. Chair support 106 may include front leg 1406. Chair support 106 may include back leg 1404.

Figure 15:
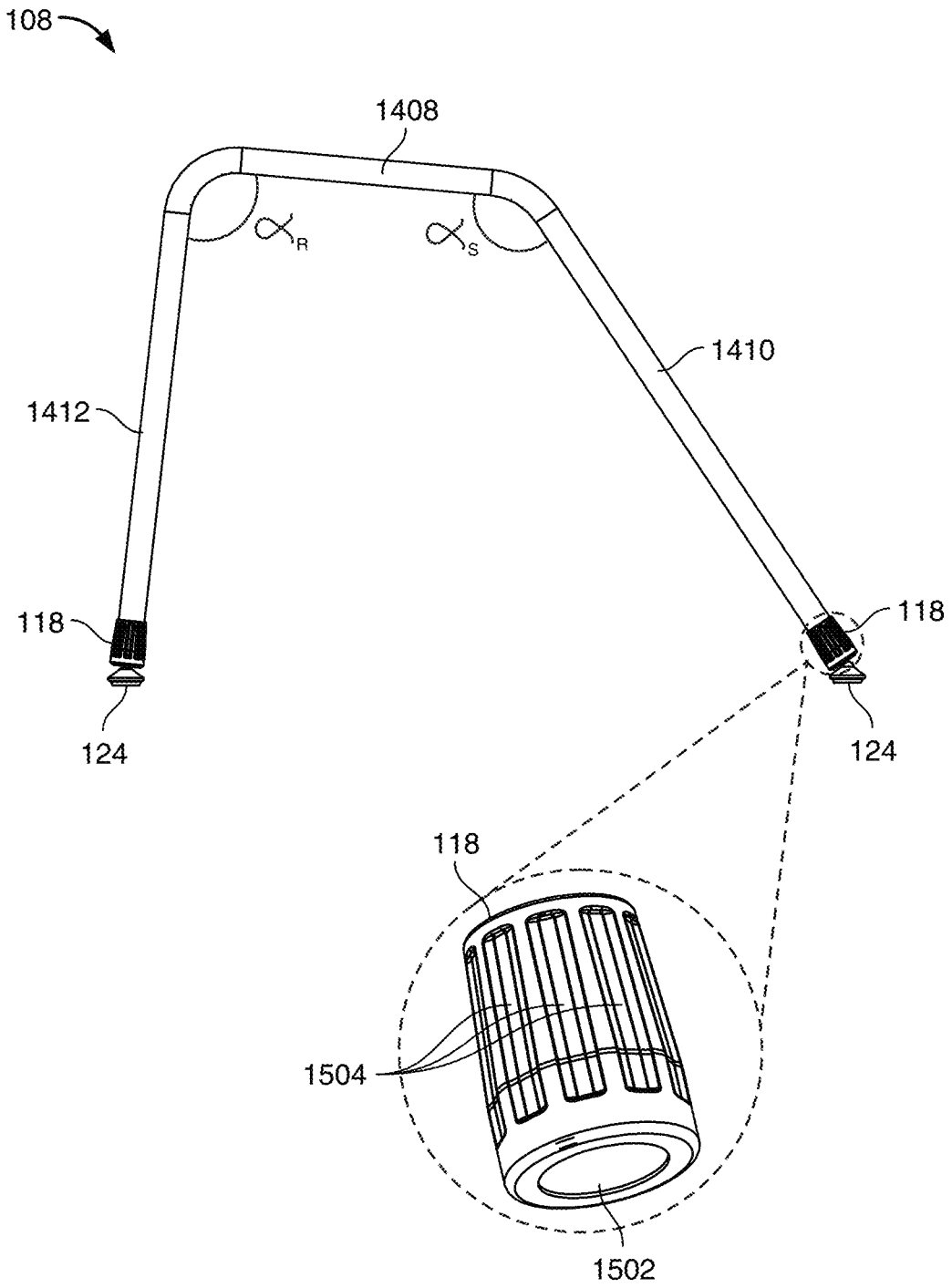
FIG. 15 shows yet another illustrative apparatus in accordance with principles of this matter.

FIG. 15 shows chair support 108. Chair support 106 may have one or more features in common with chair support 108, as described herein.

Stretcher 1408 may form angle $\alpha_R$ with front leg 1412. Stretcher 1408 may form angle as with back leg 1410. Table 4 shows illustrative angle ranges that may include angle $\alpha_R$ and angle $\alpha_S$.

TABLE 4

| Illustrative angle ranges. Illustrative angle ranges. |
|---|
| <25° |
| 25°-50° |
| 50°-75° |
| 75°-100° |
| 100°-125° |
| 125°-150° |
| 150°-175° |
| >175° |
| Other suitable angle ranges |

For example, angle $\alpha_R$ may be an angle of 91°. Angle $\alpha_R$ may be an angle of 91.34°. Angle $\alpha_R$ may be any suitable angle. Angle $\alpha_S$ may be an angle of 128°. Angle $\alpha_S$ may be an angle of 128.66°. Angle $\alpha_S$ may be any suitable angle.

Boot 118 may define bore 1502. Bore 1502 may enable boot 118 to circumscribe leg 1410. (Boot 118 may circumscribe any leg included in classroom chair 100). Boot 118 may define indents 1504.

Figure 16:
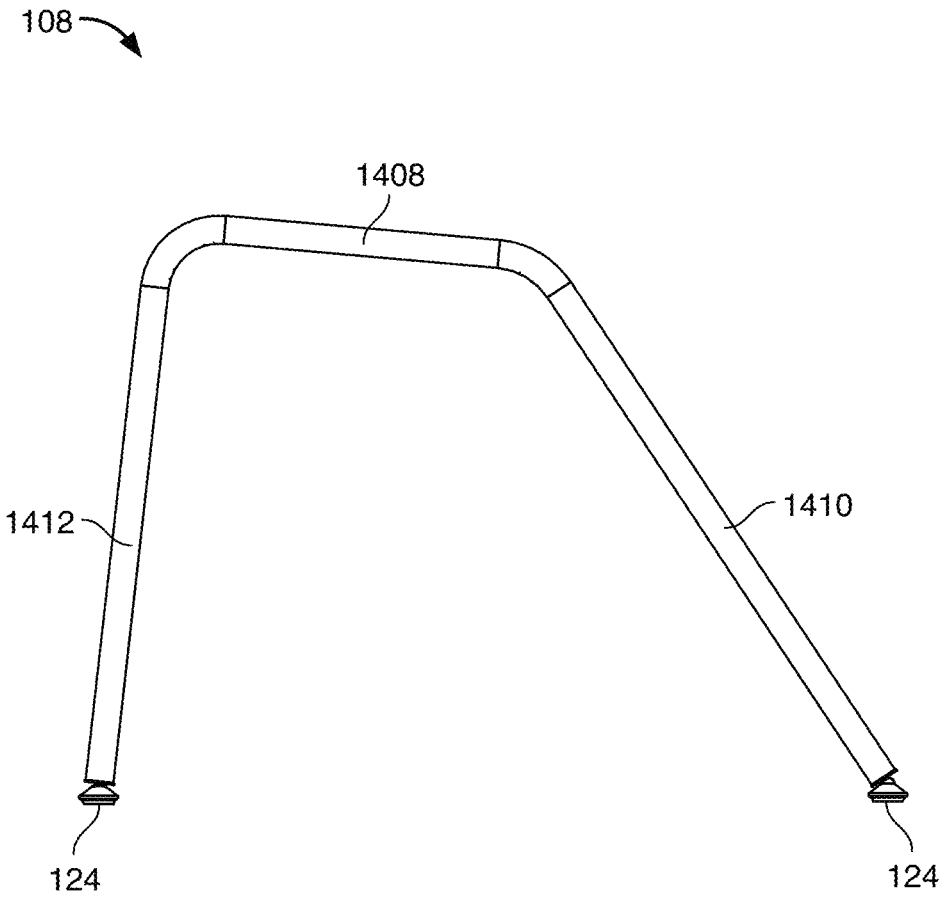
FIG. 16 shows still another illustrative apparatus in accordance with principles of this matter.

FIG. 16 shows chair support 108 without boots 118.

Figure 17A:
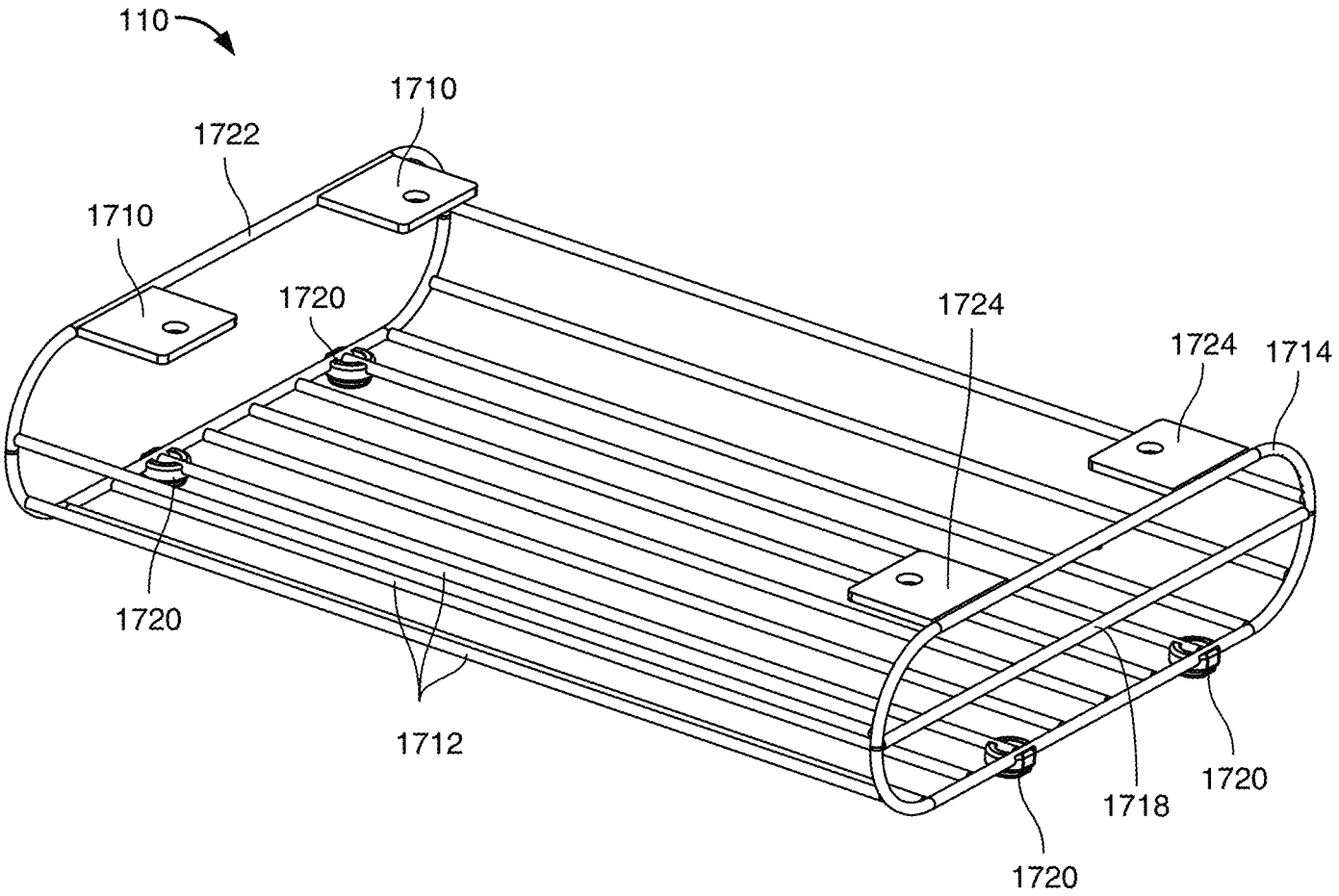
FIGS. 17A-17B show an illustrative apparatus in accordance with principles of this matter.

FIG. 17A shows book basket 110.

Book basket 110 may include frame 1714. Frame 1714 may be a stadium-shaped frame. Book basket 110 may include frame 1722. Frame 1722 may be a stadium-shaped frame. Frame 1714 may be connected to frame 1722 via plurality of connectors 1712. Plurality of connectors 1712 may be attached to frame 1714 and frame 1722 via welding, adhesives, screws and/or any other suitable method of attachment.

Mounting plates 1710 may be attached to frame 1722. Mounting plates 1710 may be attached to frame 1722 via welding, adhesives, screws and/or any other suitable method of attachment. Mounting plates 1724 may be attached to frame 1714. Mounting plates 1724 may be attached to frame 1714 via welding, adhesives, screws and/or any other suitable method of attachment. Mounting plates 1710 and mounting plates 1724 may be used to mount book basket 110 to underside 406 (not shown) of classroom chair 100 (not shown).

When frame 1714 and frame 1722 are connected via connectors 1712 and mounting plates 1710 and mounting plates 1724 are mounted to underside 406, frame 1722 may define an orifice. Frame 1722 may enable a user to insert and/or remove books and/or any suitable items into and/or out of book basket 110. Frame 1714 may include blocker 1718. Blocker 1718 may prevent any books and/or any other suitable items stored in book basket 110 from falling out of book basket 110.

Book basket 110 may include spacers 1720. Spacers 1720 may enable one classroom chair to be stacked on top of another classroom chair. Spacers 1720 may enable book basket 110 to rest on a seat pan of another classroom chair without damaging the seat pan.

Figure 17B:
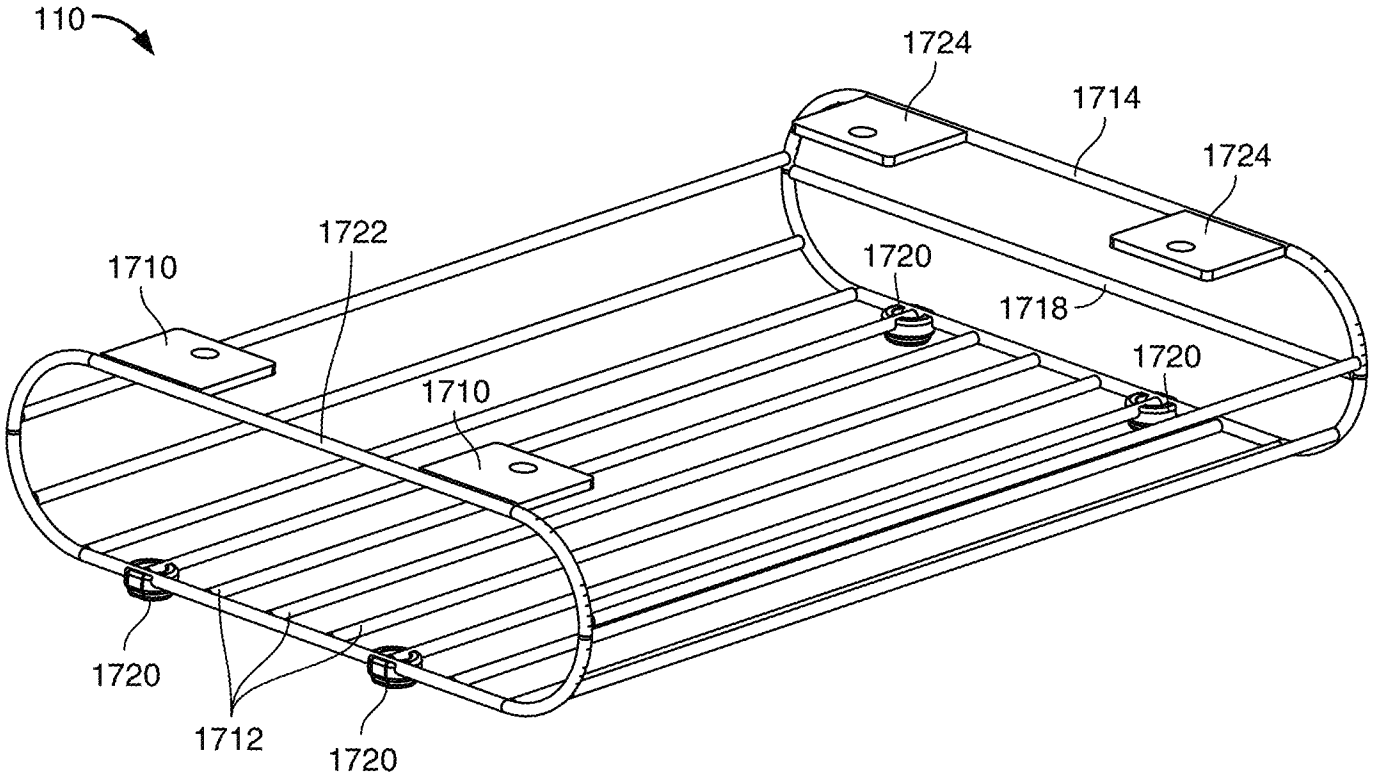

FIG. 17B shows another view of book basket 110.

Figure 18A:
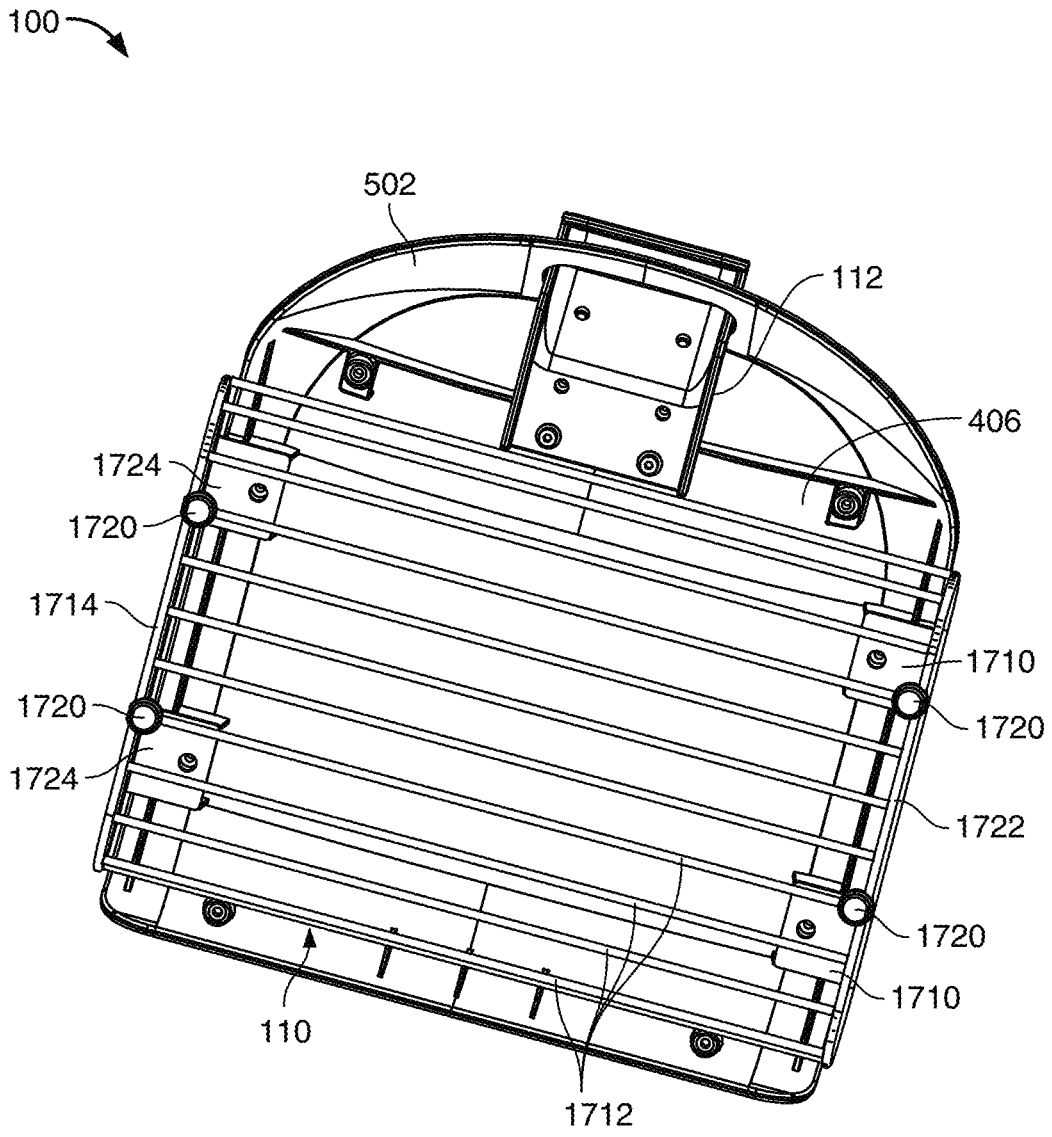
FIGS. 18A-18C show yet another illustrative apparatus in accordance with principles of this matter.

FIG. 18A shows book basket 110 mounted to underside 406 of classroom chair 100.

Book basket 110 may be mounted to underside 406 using screws (not shown). Book basket 110 may be mounted to underside 406 via welding. Book basket 110 may be mounted to underside 406 via adhesives. Book basket 110 may be mounted to underside 406 via any suitable permanent or temporary attachment mechanism.

Figure 18B:
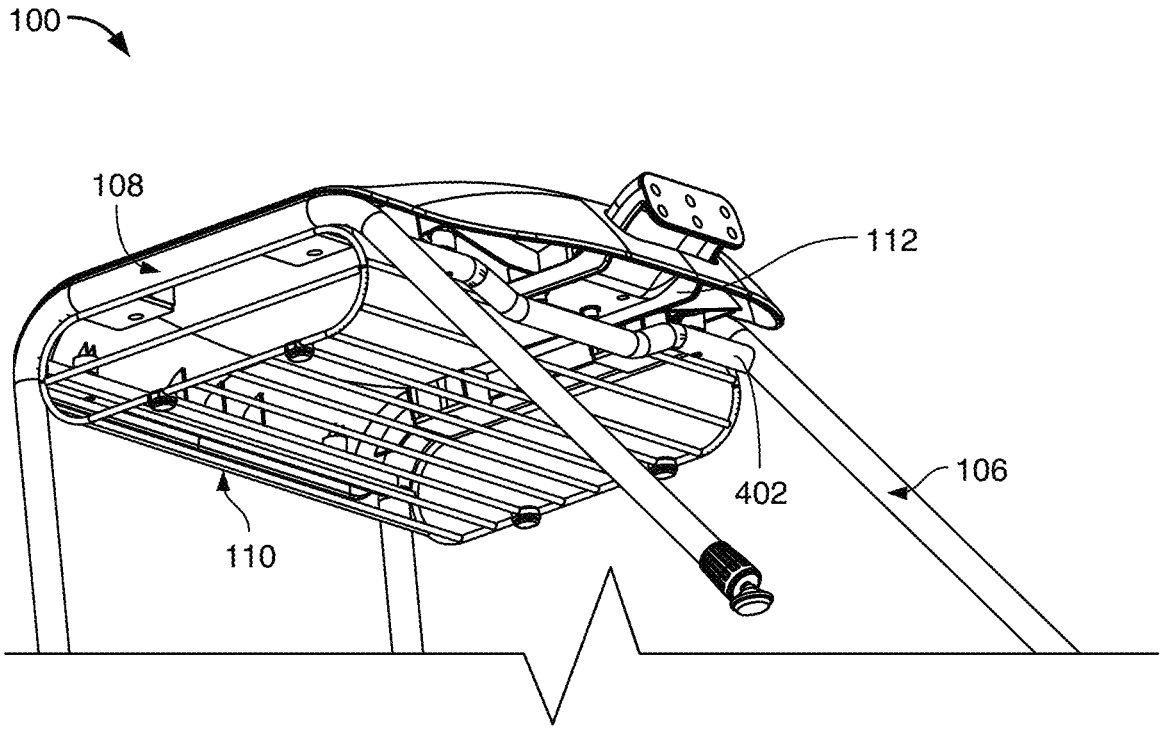

FIG. 18B shows another view of book basket 110 attached to underside 406 of classroom chair 100.

It should be noted that bar 402 may be shaped in a curved shape. As such, bar 402 may not interfere with book basket 110. Bar 402 may not interfere with book basket 110 in addition to not interfering with bracket 112. Bracket 112 may not interfere with book basket 110.

Figure 18C:
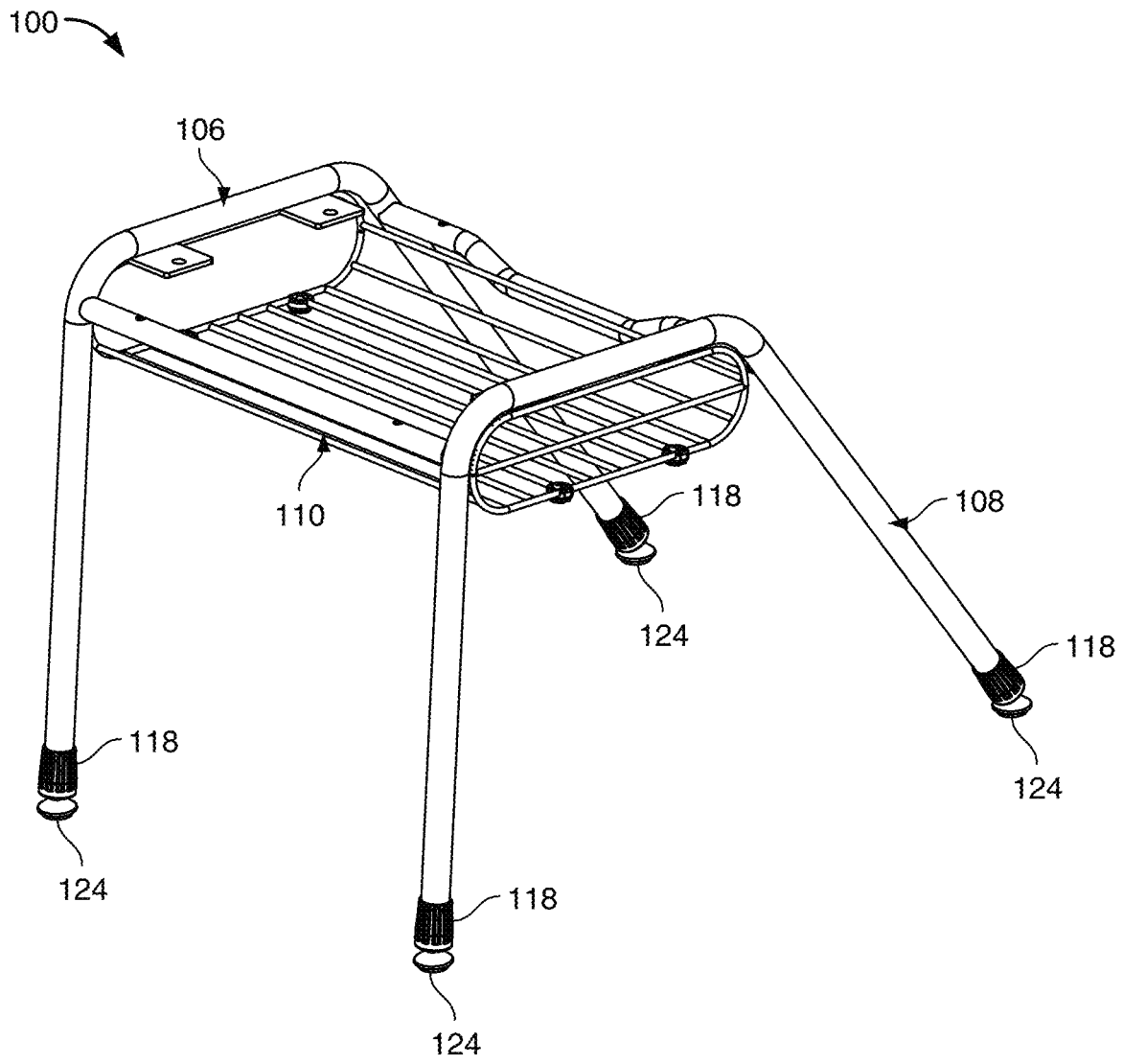

FIG. 18C shows book basket 110 flush with chair support 108 and chair support 106.

Figure 19:
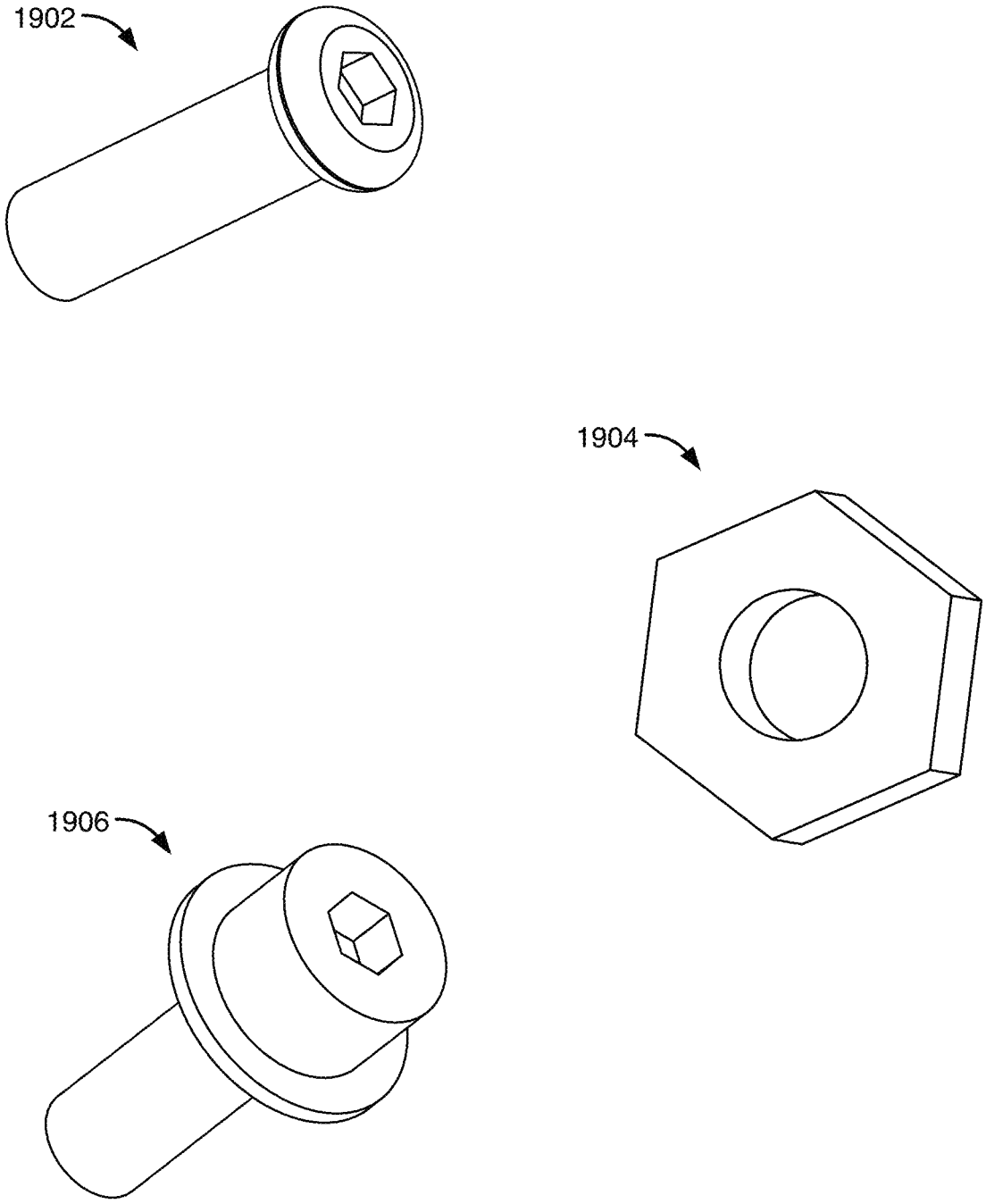
FIG. 19 shows still another illustrative apparatus in accordance with principles of this matter.

FIG. 19 shows illustrative screw components 1902, 1904 and 1906.

Screw components 1902, 1904 and 1906 may be used to connect/attach/mount different elements of classroom chair 100 as described above.

Figure 20:
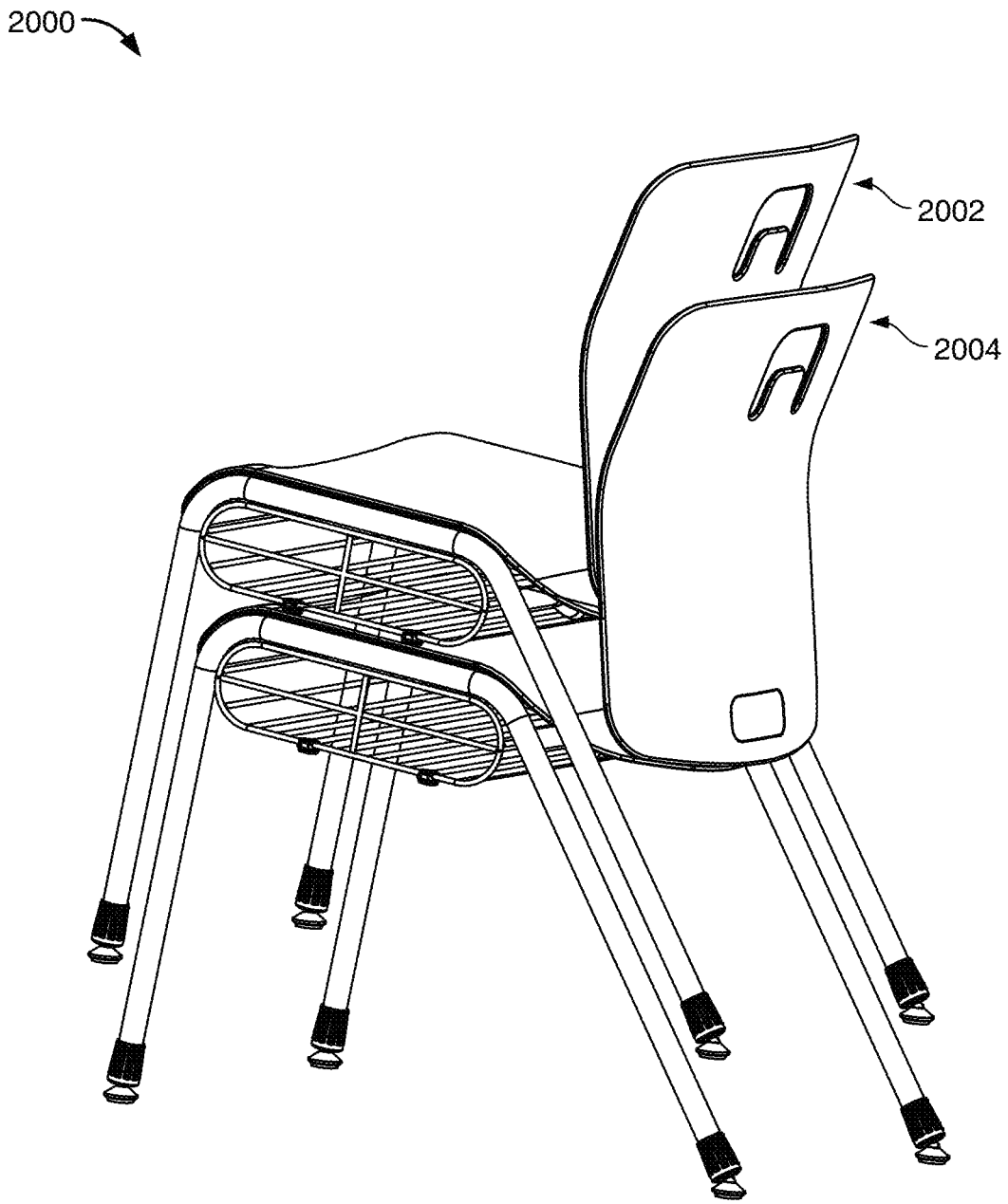
FIG. 20 shows an illustrative apparatus in accordance with principles of this matter.

FIG. 20 shows stacked classroom chairs 2000. Each of classroom chairs 2002 and 2004 may have one or more features in common with classroom chair 100.

Figure 21:
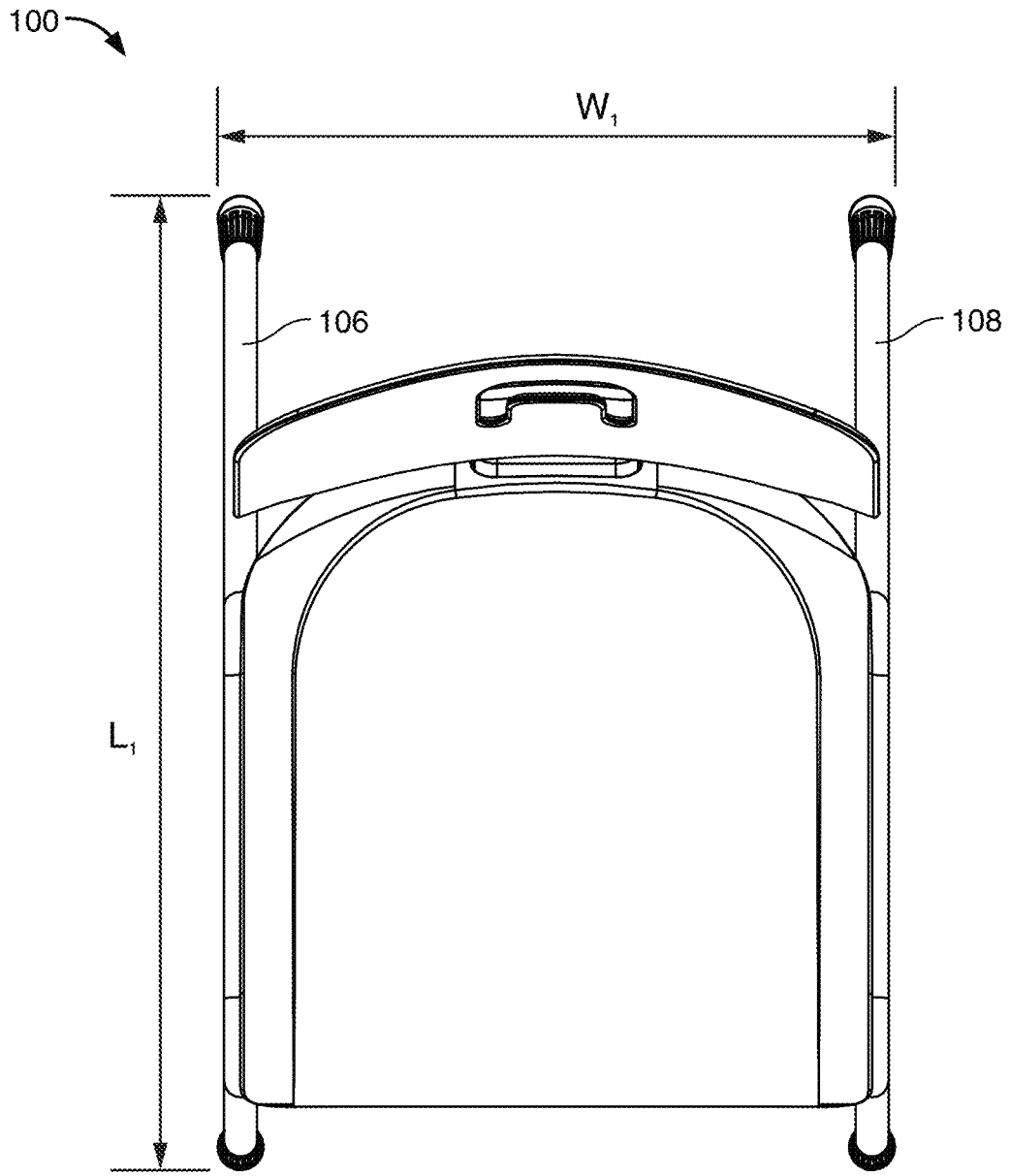
FIG. 21 shows another illustrative apparatus in accordance with principles of this matter.

FIG. 21 shows another top view of classroom chair 100. Table 5 lists the dimensions and corresponding ranges of classroom chair 100.

TABLE 5

Illustrative dimensions and corresponding ranges of classroom chair 100.
Illustrative dimensions

| Dimension | Lower limit (inches) | Upper limit (inches) | Example (inches) |
|---|---|---|---|
| $L_1$ | ≤10 | ≥75 | 25.50 |
| $W_1$ | ≤5 | ≥50 | 17.75 |
| Other suitable dimensions | Other suitable ranges | Other suitable range | Other suitable examples |

Figure 22:
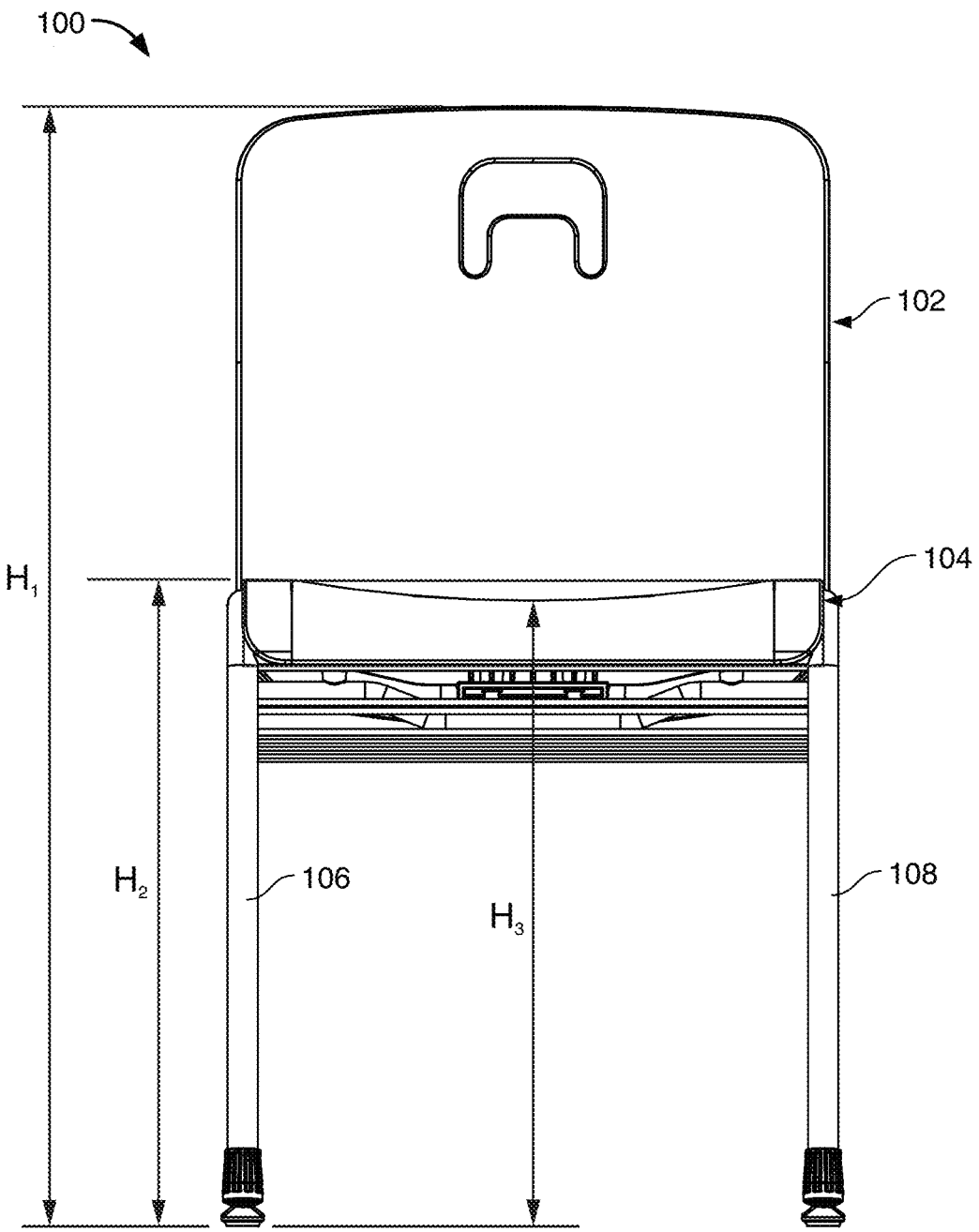
FIG. 22 shows yet another illustrative apparatus in accordance with principles of this matter.

FIG. 22 shows another front view of classroom chair 100. Table 6 lists the dimensions and corresponding ranges of classroom chair 100.

TABLE 6

Illustrative dimensions and corresponding ranges of classroom chair 100.
Illustrative dimensions

| Dimension | Lower limit (inches) | Upper limit (inches) | Example (inches) |
|---|---|---|---|
| $H_1$ | ≤2 | ≥50 | 32.00 |
| $H_2$ | ≤2 | ≥50 | 18.50 |
| $H_3$ | ≤2 | ≥50 | 17.888 |
| Other suitable dimensions | Other suitable ranges | Other suitable ranges | Other suitable examples |

Figure 23:
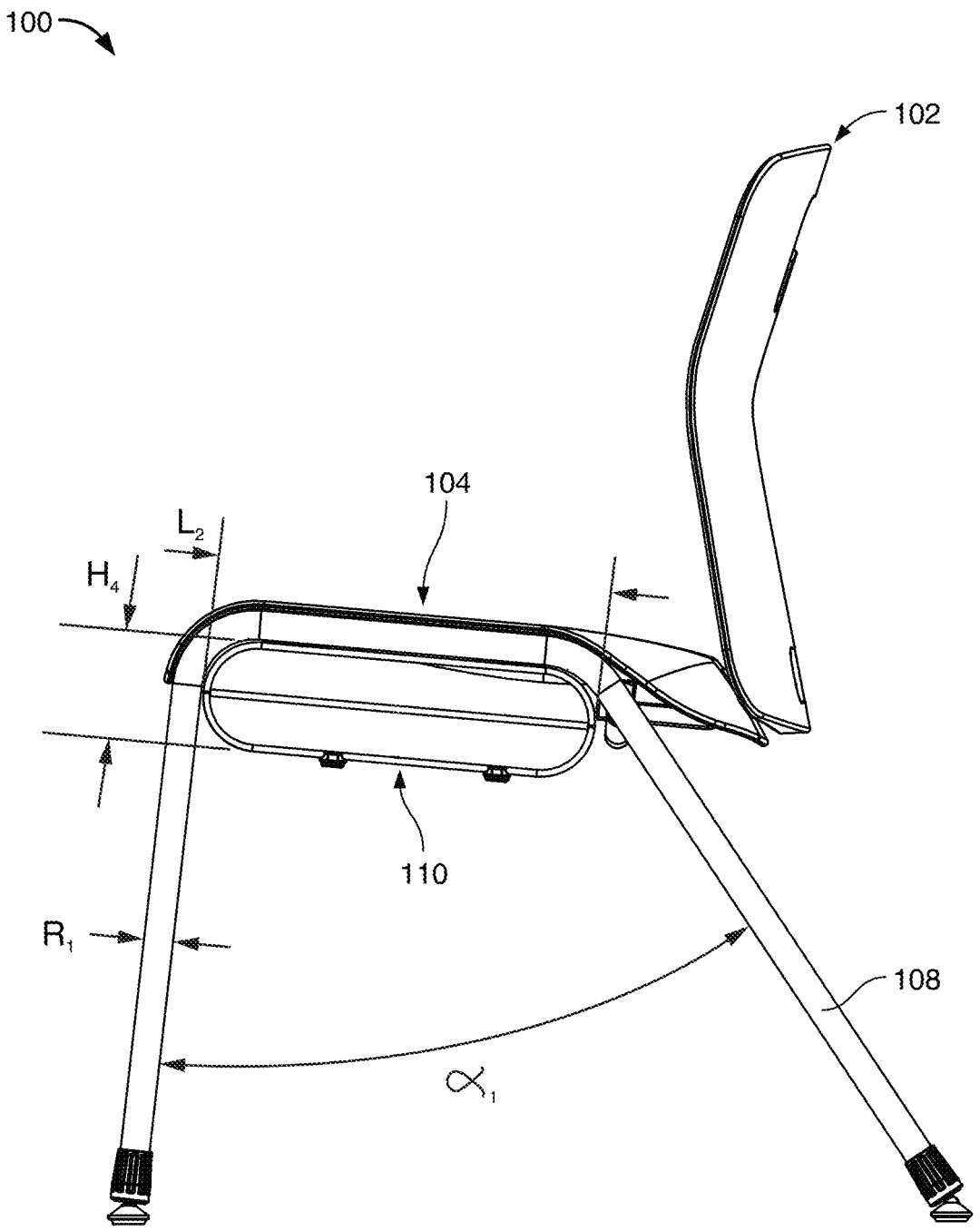
FIG. 23 shows still another illustrative apparatus in accordance with principles of this matter.

FIG. 23 shows another side view of classroom chair 100. Table 7 lists the dimensions and corresponding ranges of classroom chair 100.

TABLE 7

Illustrative dimensions and corresponding ranges of classroom chair 100.
Illustrative dimensions

| Dimension | Lower limit (inches) | Upper limit (inches) | Example (inches) |
|---|---|---|---|
| $H_4$ | ≤1 | ≥15 | 3.247 |
| $L_2$ | ≤1 | ≥25 | 11.654 |
| $R_1$ | ≤.05 | ≥5 | 0.866 |
| $\alpha_1$ | ≤1° | ≥90° | 40° |
| Other suitable dimensions | Other suitable ranges | Other suitable ranges | Other suitable examples |

Figure 24A:
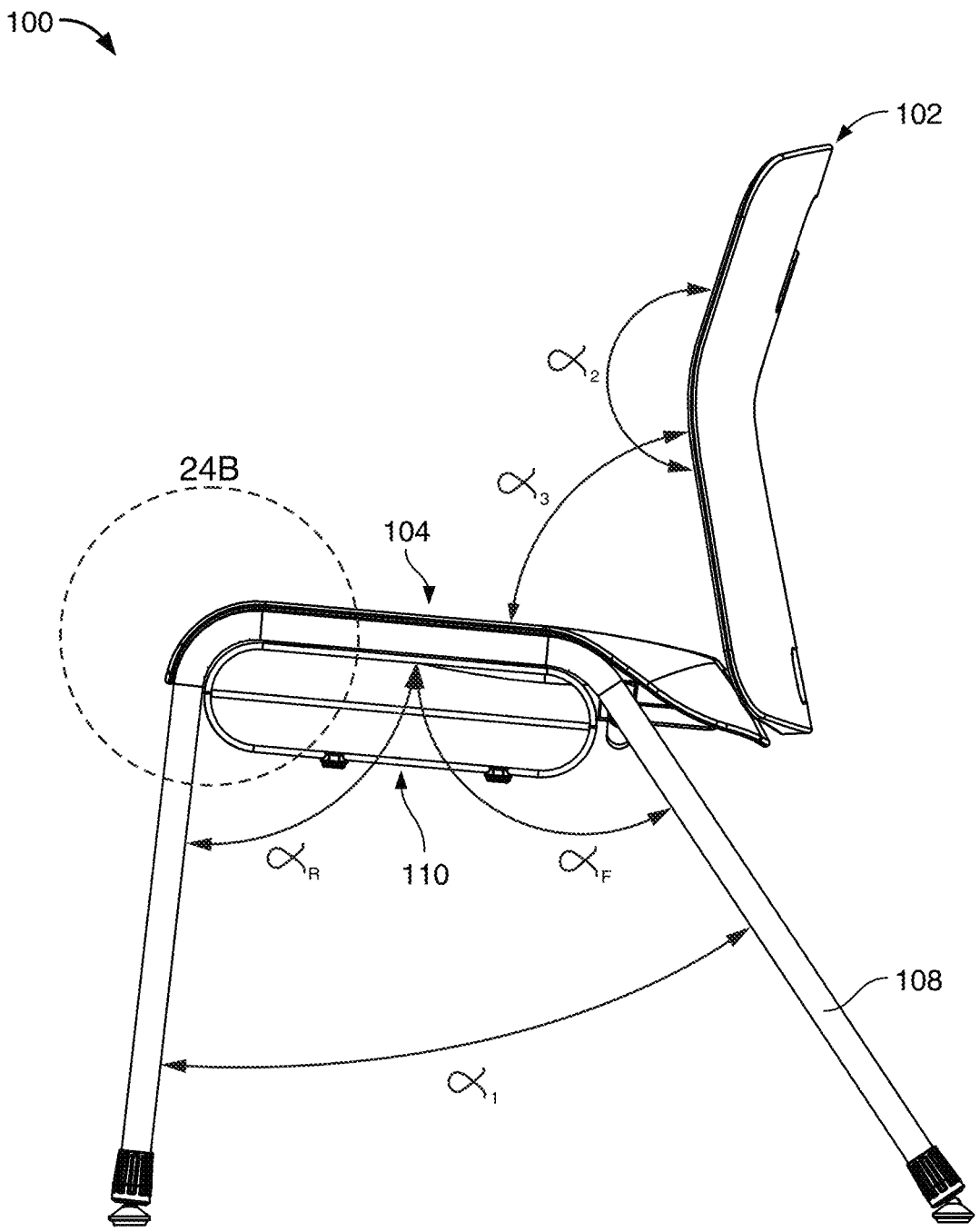
FIG. 24A-24B shows an illustrative apparatus in accordance with principles of this matter.

FIG. 24A shows another side view of classroom chair 100. Table 8 lists the dimensions and corresponding ranges of classroom chair 100.

TABLE 8

Illustrative dimensions and corresponding ranges of classroom chair 100.
Illustrative dimensions

| Dimension | Lower limit (degrees) | Upper limit (degrees) | Example (degrees) |
|---|---|---|---|
| $\alpha_1$ | ≤any value as listed in table 7 | any value as listed in table 7 | 40 |
| $\alpha_2$ | ≤45 | ≥360 | 207.19 |
| $\alpha_3$ | ≤15 | ≥175 | 75.6 |
| $\alpha_R$ | ≤any value as listed in table 4 | ≥any value as listed in table 4 | 91.34 |
| $\alpha_S$ | ≤any value as listed in table 4 | ≥any value as listed in table 4 | 128.66 |
| Other suitable dimensions | Other suitable ranges | Other suitable ranges | Other suitable examples |

Figure 24B:
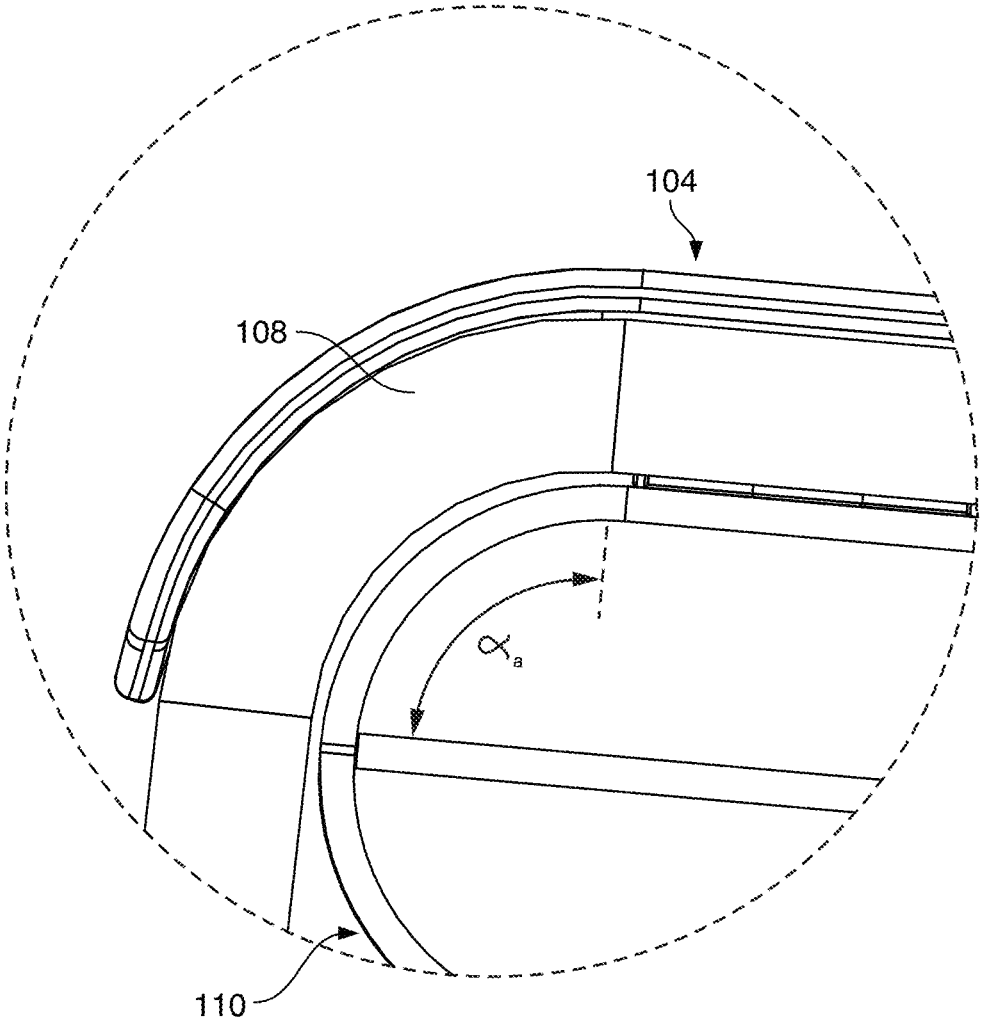

FIG. 24B shows section A taken from side view of classroom chair 100. Table 9 lists the dimensions and corresponding ranges of classroom chair 100.

TABLE 9

| Illustrative dimensions and corresponding ranges of classroom chair 100. Illustrative dimensions | | | |
|---|---|---|---|
| Dimension | Lower limit (degrees) | Upper limit (degrees) | Example (degrees) |
| $\alpha_a$ | ≤any value as listed in table 2 | any value as listed in table 2 | 90 |
| Other suitable dimensions | Other suitable ranges | Other suitable ranges | Other suitable examples |

Figure 25:
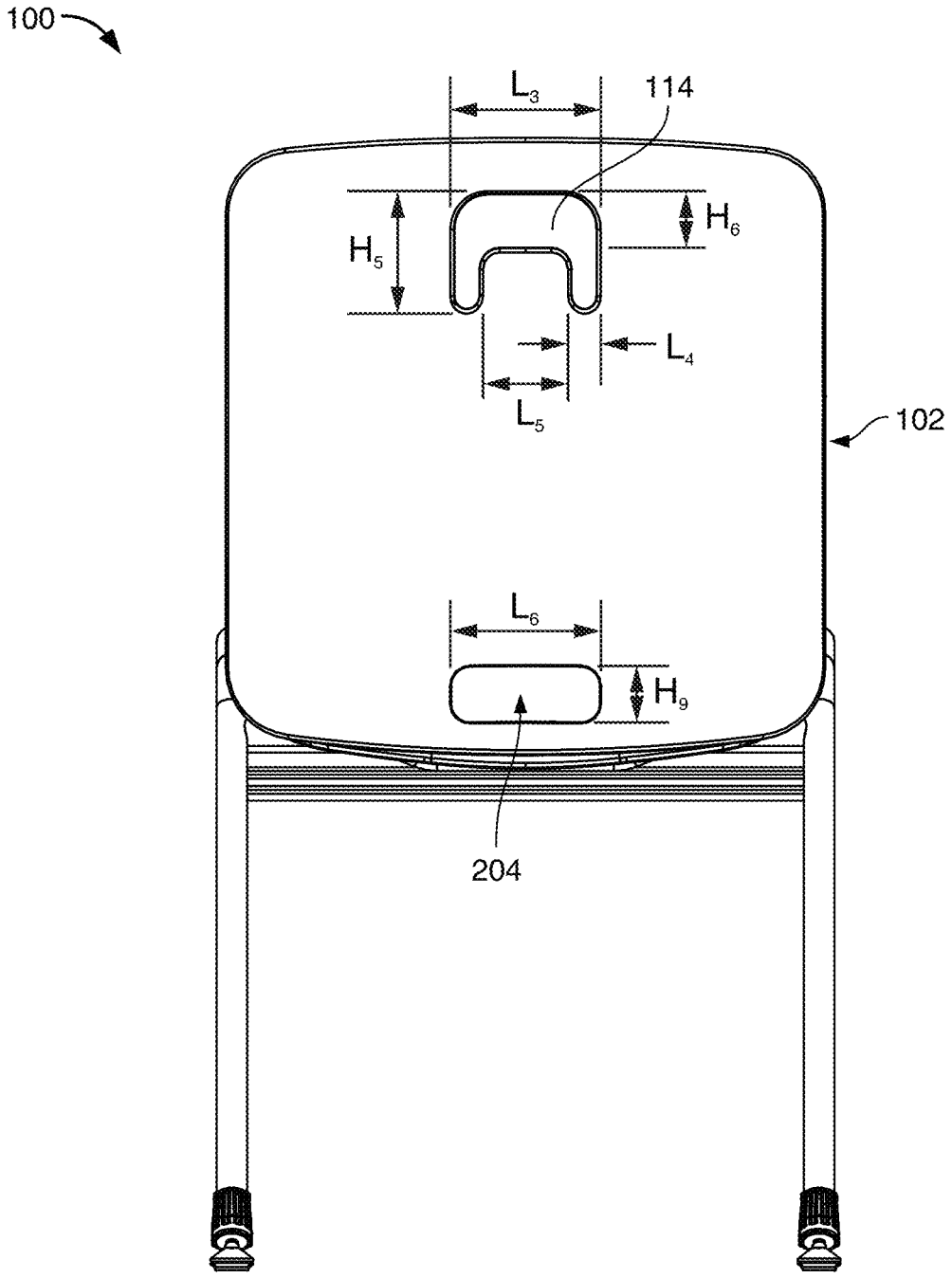
FIG. 25 shows another illustrative apparatus in accordance with principles of this matter.

FIG. 25 shows another back view of classroom chair 100. Table 10 lists the dimensions and corresponding ranges of classroom chair 100.

TABLE 10

| Illustrative dimensions and corresponding ranges of classroom chair 100. Illustrative dimensions | | | |
|---|---|---|---|
| Dimension | Lower limit (inches) | Upper limit (inches) | Example (inches) |
| $H_5$ | ≤1 | ≥15 | 3.461 |
| $H_6$ | 5.05 | ≥10 | 1.733 |
| $H_7$ | 5.05 | ≥10 | 1.643 |
| $L_3$ | ≤1 | ≥15 | 4.248 |
| $L_4$ | ≤.025 | ≥10 | 0.925 |
| $L_5$ | ≤1 | ≥10 | 2.397 |
| $L_6$ | ≤1 | ≥15 | 4.266 |
| Other suitable dimensions | Other suitable ranges | Other suitable ranges | Other suitable examples |

Figure 26:
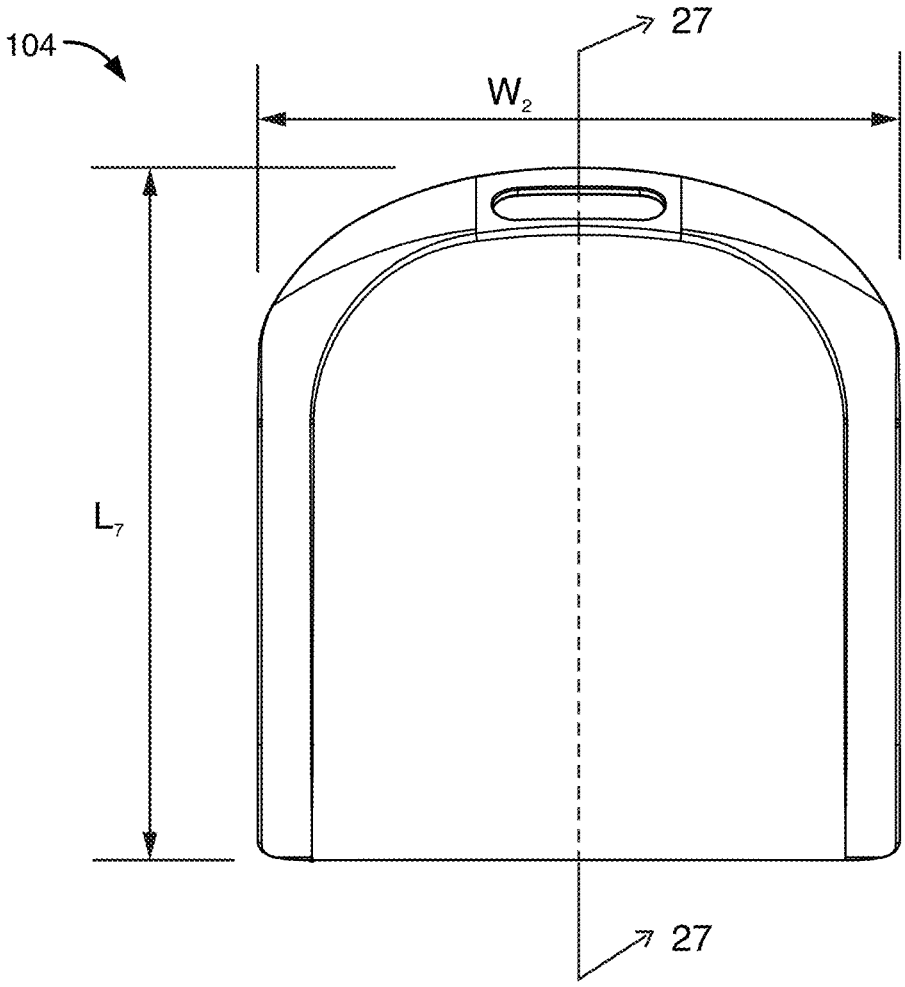
FIG. 26 shows yet another illustrative apparatus in accordance with principles of this matter.

FIG. 26 shows another view of chair seat 104. Table 11 lists the dimensions and corresponding ranges of chair seat 104.

TABLE 11

| Illustrative dimensions and corresponding ranges of chair seat 104. Illustrative dimensions | | | |
|---|---|---|---|
| Dimension | Lower limit (inches) | Upper limit (inches) | Example (inches) |
| $W_2$ | ≤5 | ≥50 | 16.586 |
| $L_7$ | ≤5 | ≥50 | 17.896 |
| Other suitable dimensions | Other suitable ranges | Other suitable ranges | Other suitable examples |

Figure 27:
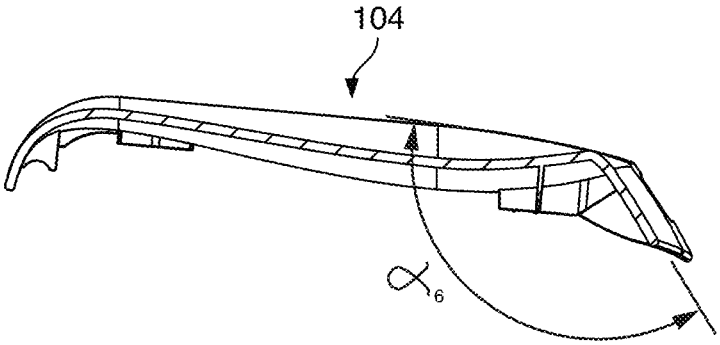
FIG. 27 shows still another illustrative apparatus in accordance with principles of this matter.

FIG. 27 shows a cross-sectional view of chair seat 104 taken along view lines 27-27. Table 12 lists the dimensions and corresponding ranges of chair seat 104.

TABLE 12

| Illustrative dimensions and corresponding ranges of chair seat 104. Illustrative dimensions | | | |
|---|---|---|---|
| Dimension | Lower limit (degrees) | Upper limit (degrees) | Example (degrees) |
| $\alpha_6$ | ≤45 | ≥275 | 129.8 |

TABLE 12-continued

| Illustrative dimensions and corresponding ranges of chair seat 104. Illustrative dimensions | | | |
|---|---|---|---|
| Dimension | Lower limit (degrees) | Upper limit (degrees) | Example (degrees) |
| Other suitable dimensions | Other suitable ranges | Other suitable ranges | Other suitable examples |

Figure 28:
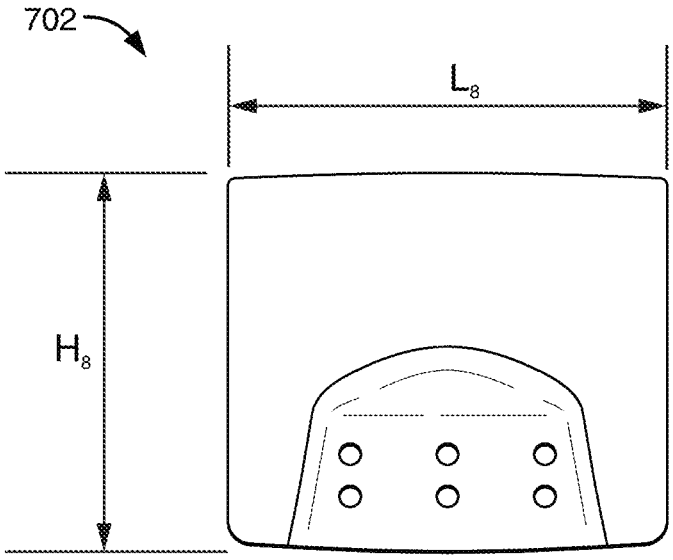
FIG. 28 shows an illustrative apparatus in accordance with principles of this matter.

FIG. 28 shows another view of steel plate 702. Table 13 lists the dimensions and corresponding ranges of steel plate 702.

TABLE 13

| Illustrative dimensions and corresponding ranges of steel plate 702. Illustrative dimensions | | | |
|---|---|---|---|
| Dimension | Lower limit (inches) | Upper limit (inches) | Example (inches) |
| $L_8$ | ≤1 | ≥25 | 7.107 |
| $H_8$ | ≤1 | ≥25 | 6.148 |
| Other suitable dimensions | Other suitable ranges | Other suitable ranges | Other suitable examples |

Figure 29:
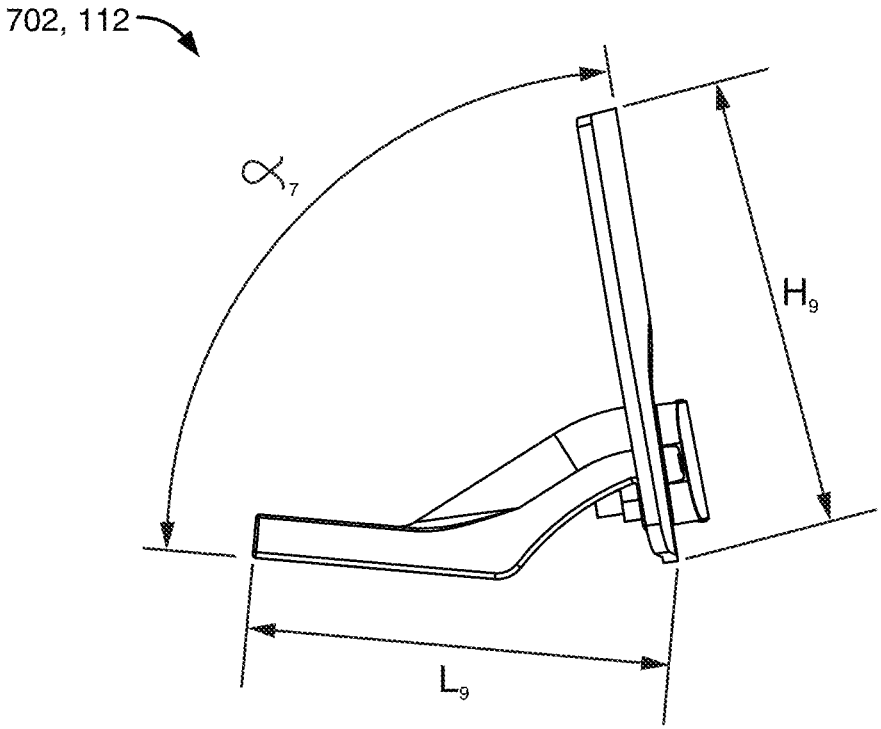
FIG. 29 shows another illustrative apparatus in accordance with principles of this matter.

FIG. 29 shows another view of steel plate 702 and bracket 112. Table 14 lists the dimensions and corresponding ranges of steel plate 702 and bracket 112.

TABLE 14

| Illustrative dimensions and corresponding ranges of steel plate 702 and bracket 112. Illustrative dimensions | | | |
|---|---|---|---|
| Dimension | Lower limit (inches) | Upper limit (inches) | Example (inches) |
| $L_9$ | ≤1 | ≥25 | 5.728 |
| $H_9$ | ≤1 | ≥25 | 6.138 |
| $\alpha_7$ | ≤25° | ≥175° | 75.49° |
| Other suitable dimensions | Other suitable ranges | Other suitable ranges | Other suitable examples |

Thus, methods and systems for a book basket are provided. Persons skilled in the art will appreciate that the present invention can be practiced by other than the described embodiments, which are presented for purposes of illustration rather than of limitation, and that the present invention is limited only by the claims that follow.

What is claimed is:

1. A chair comprising:

a chair back:

housing a steel plate; and defining a first aperture, the first aperture exposing at least a portion of a face of the steel plate;

a chair seat defining a back-to-front axis, said back of said back-to-front axis with respect to the chair back, said chair seat defining a second aperture;

a steel bracket configured to connect an underside of the chair seat to the steel plate, the steel bracket extending through the second aperture;

a first chair support, said first chair support extending parallel to the back-to-front axis;
comprising two legs; and
being disposed on a first side of the chair seat;
a second chair support, said second chair support:
extending parallel to the back-to-front axis;
comprising two legs; and
being disposed on a second side of the chair seat;
a first bar configured to connect the first chair support and the second chair support;
a second bar configured to connect the first chair support and the second chair support; and
a book basket comprising:
a frame comprising:
a first oblong shaped orifice;
a second oblong shaped orifice; and
a plurality of connectors connecting the first oblong shaped orifice to the second oblong shaped orifice;
wherein:
the first oblong shaped orifice enables insertion and removal of one or more items;
the second oblong shaped orifice includes a blocker to prevent insertion and removal of the one or more items;
a first curvature of the first oblong shaped orifice is configured to match a first curvature of the chair seat; and
a second curvature of the second oblong shaped orifice is configured to match a second curvature of the chair seat.

2. The chair of claim 1 wherein the first curvature of the first oblong shaped orifice corresponds to the second curvature of the second oblong shaped orifice.

3. The chair of claim 1 wherein the book basket is configured to be connected flush with the underside of the chair seat.

4. The chair of claim 1 wherein:
the book basket is configured to be installed with the second oblong shaped orifice on the first side of the chair seat; or
the book basket is configured to be installed with the second oblong shaped orifice on the second side of the chair seat.

5. The chair of claim 1 wherein the book basket enables vertical stacking of four chairs per linear yard.

6. The chair of claim 5 wherein the book basket further comprises a plurality of spacers on a portion of the plurality of connectors located on an underside of the book basket, the plurality of spacers provides a portion of space between each chair when the chair is vertically stacked with another chair.

7. The chair of claim 1 wherein the book basket comprises steel.

8. The chair of claim 1 wherein the book basket includes a powder coat.

9. The chair of claim 1 wherein the book basket is configured to be attachable to and/or removable from the chair.

10. A stack of multiple chairs, each of the multiple chairs comprising a book basket, the stack comprising:
a first chair comprising:
a first chair back:
housing a first steel plate; and
defining a first aperture, the first aperture exposing at least a portion of a face of the first steel plate;
a first chair seat defining a back-to-front axis, said back of said back-to-front axis with respect to the first chair back, defining a second aperture;
a first steel bracket configured to connect an underside of the first chair seat to the first steel plate, the first steel bracket extending through the second aperture;
a first chair support, said first chair support:
extending parallel to the back-to-front axis;
comprising two legs; and
being disposed on a first side of the first chair seat;
a second chair support, said second chair support:
extending parallel to the back-to-front axis;
comprising two legs; and
being disposed on a second side of the first chair seat;
a first bar configured to connect the first chair support and the second chair support;
a second bar configured to connect the first chair support and the second chair support; and
a first book basket comprising:
a first frame comprising:
a first oblong shaped orifice;
a second oblong shaped orifice;
a first plurality of connectors connecting the first oblong shaped orifice to the second oblong shaped orifice; and
a first plurality of stoppers connected to the first plurality of connectors;
a second chair comprising:
a second chair back:
housing a second steel plate; and
defining a third aperture, the third aperture exposing at least a portion of a face of the second steel plate;
a second chair seat defining a back-to-front axis, said back-to-front axis with respect to the second chair back, defining a fourth aperture;
a second steel bracket configured to connect an underside of the second chair seat to the second steel plate, the second steel bracket extending through the fourth aperture;
a third chair support, said third chair support:
extending parallel to the back-to-front axis;
comprising two legs; and
being disposed on a first side of the second chair seat;
a fourth chair support, said fourth chair support:
extending parallel to the back-to-front axis;
comprising two legs; and
being disposed on a second side of the second chair seat;
a third bar configured to connect the third chair support and the fourth chair support;
a fourth bar configured to connect the third chair support and the fourth chair support; and
a second book basket comprising:
a second frame comprising:
a third oblong shaped orifice;
a fourth oblong shaped orifice;
a second plurality of connectors connecting the third oblong shaped orifice to the fourth oblong shaped orifice; and
a second plurality of stoppers connected to the second plurality of connectors;
wherein:
the first book basket is configured to be installed flush with the first chair seat;
the second book basket is configured to be installed flush with second chair seat; and
the first plurality of stoppers prevent the first chair from touching the second chair.

11. The stack of claim 10 wherein the first chair and the second chair are configured to be stacked with a third chair and a fourth chair.

12. The stack of claim 10 wherein the stack further comprises stacking four chairs per linear yard.

* * * * *